US009157453B2

(12) United States Patent
Wenger et al.

(10) Patent No.: US 9,157,453 B2
(45) Date of Patent: Oct. 13, 2015

(54) PLASTIC FAN SHROUD AND CONE ASSEMBLY AND METHOD

(75) Inventors: Curtis Wenger, Goshen, IN (US); James R. Kraft, New Paris, IN (US)

(73) Assignee: CTB, Inc., Milford, IN (US)

( * ) Notice: Subject to any disclaimer, the term of this patent is extended or adjusted under 35 U.S.C. 154(b) by 1076 days.

(21) Appl. No.: 13/215,840

(22) Filed: Aug. 23, 2011

(65) Prior Publication Data

US 2013/0051999 A1 Feb. 28, 2013

(51) Int. Cl.

| | |
|---|---|
| ***F24F 7/10*** | (2006.01) |
| ***F04D 25/08*** | (2006.01) |
| ***F04D 29/54*** | (2006.01) |
| ***F04D 29/52*** | (2006.01) |
| ***F04D 25/14*** | (2006.01) |

(52) U.S. Cl.

CPC ..... *F04D 29/522* (2013.01); *F04D 25/08* (2013.01); *F04D 25/14* (2013.01); *F04D 29/545* (2013.01); *Y10T 29/49245* (2015.01)

(58) Field of Classification Search

CPC . A01K 1/0047; A01K 1/0052; A01K 1/0058; A01K 1/0064; F24F 7/00; F24F 7/02; F24F 7/025; F24F 13/02; F24F 13/0218; F24F 13/0245; F24F 13/0272; F24F 13/082; F24F 13/084; F24F 13/18; F24F 221/14; F24F 221/16; F24F 221/32; F24F 221/36; F24F 221/17; F24F 7/013; F24F 7/003; F24F 7/10; F04D 19/002; F04D 25/08; F04D 25/12; F04D 25/14; F04D 29/522; F04D 29/545; F04D 29/54; F05D 2230/51

USPC ..... 415/185, 187, 189, 190, 200, 201, 207, 415/211.2, 213.1, 214.1, 219.1, 202, 223, 415/909; 416/142, 135; 454/322, 353, 369, 454/904

See application file for complete search history.

(56) References Cited

U.S. PATENT DOCUMENTS

| | | | | |
|---|---|---|---|---|
| 2,055,592 A | | 9/1936 | Roed | |
| 2,305,426 A | * | 12/1942 | Howell | 229/74 |
| 2,376,642 A | * | 5/1945 | Waterman et al. | 206/577 |
| 2,489,446 A | * | 11/1949 | Biancani | 454/351 |
| 2,738,915 A | * | 3/1956 | St Clair | 229/406 |
| 2,758,727 A | * | 8/1956 | Clingman | 206/592 |
| 2,762,118 A | * | 9/1956 | Shaw et al. | 29/521 |
| 2,912,920 A | | 11/1959 | Coe | |
| 3,308,744 A | | 3/1967 | Schach | |

(Continued)

FOREIGN PATENT DOCUMENTS

WO WO-2010/060427 A1 6/2010

OTHER PUBLICATIONS

Chore-Time Equipment, "48" and 52" Hyflo™ Fans Installation and Operators Instruction Manual", Jul. 2003.

(Continued)

*Primary Examiner* — Dwayne J White
*Assistant Examiner* — Joshua R Beebe
(74) *Attorney, Agent, or Firm* — Harness, Dickey

(57) ABSTRACT

A manufacturing method and assembly for providing ventilation to a selected structure is disclosed. The assembly may include various features such as flexible portions, rigid portions, and assembly portions. Further, various steps may be used to form the assembly to achieve selected results, such as single piece formation, inclusion of various positioning members, and packaging or shipping considerations.

25 Claims, 18 Drawing Sheets

(56) References Cited

U.S. PATENT DOCUMENTS

| | | | | | |
|---|---|---|---|---|---|
| 3,425,380 | A | | 2/1969 | Krainer et al. | |
| 3,524,289 | A | * | 8/1970 | Yazejian | 52/95 |
| 3,827,825 | A | * | 8/1974 | Shipes | 415/220 |
| 3,895,650 | A | | 7/1975 | Cadiou | |
| 4,006,672 | A | * | 2/1977 | Matsuyoshi et al. | 454/343 |
| 4,094,336 | A | | 6/1978 | Urschel et al. | |
| 4,336,749 | A | * | 6/1982 | Barnhart et al. | 454/349 |
| 4,353,680 | A | | 10/1982 | Hiraoka et al. | |
| 4,372,196 | A | | 2/1983 | Henderson | |
| 4,394,111 | A | * | 7/1983 | Wiese et al. | 417/360 |
| 4,406,216 | A | * | 9/1983 | Hott et al. | 454/349 |
| 4,594,940 | A | * | 6/1986 | Wolbrink et al. | 454/346 |
| 4,703,570 | A | * | 11/1987 | Fast | 40/657 |
| 4,779,518 | A | * | 10/1988 | Artwick et al. | 454/353 |
| 4,986,469 | A | | 1/1991 | Sutton, Jr. | |
| 5,236,391 | A | | 8/1993 | Schaefer | |
| 5,294,049 | A | * | 3/1994 | Trunkle et al. | 236/49.5 |
| 5,336,131 | A | | 8/1994 | Crider et al. | |
| 5,535,804 | A | | 7/1996 | Guest | |
| 5,538,074 | A | | 7/1996 | Meyer | |
| 5,567,200 | A | * | 10/1996 | Swartzendruber | 454/338 |
| 5,575,622 | A | * | 11/1996 | Zimmerman et al. | 415/213.1 |
| 5,716,271 | A | * | 2/1998 | Paidosh | 454/359 |
| 5,924,922 | A | | 7/1999 | Eakin et al. | |
| 6,189,492 | B1 | * | 2/2001 | Brown | 123/41.49 |
| 6,378,322 | B1 | | 4/2002 | Calvert | |
| 6,386,828 | B1 | | 5/2002 | Davis et al. | |
| 6,616,404 | B1 | | 9/2003 | Davis et al. | |
| 6,653,773 | B1 | * | 11/2003 | Lee | 313/477 R |
| 7,611,403 | B2 | | 11/2009 | Wenger | |
| 7,677,964 | B1 | * | 3/2010 | Bucher et al. | 454/356 |
| 2001/0030167 | A1 | * | 10/2001 | Mooney | 215/384 |
| 2003/0060155 | A1 | | 3/2003 | Baumgartner et al. | |
| 2003/0131891 | A1 | * | 7/2003 | Sinur et al. | 137/527.8 |
| 2005/0005564 | A1 | * | 1/2005 | Bennett et al. | 52/677 |
| 2006/0105696 | A1 | * | 5/2006 | Wenger | 454/254 |
| 2006/0272800 | A1 | * | 12/2006 | Wong et al. | 165/120 |
| 2007/0045974 | A1 | * | 3/2007 | Young | 280/47.26 |
| 2008/0236518 | A1 | * | 10/2008 | Schaffer et al. | 123/41.49 |
| 2009/0023378 | A1 | * | 1/2009 | Hansen et al. | 454/259 |
| 2009/0260294 | A1 | * | 10/2009 | Sullivan | 49/394 |
| 2011/0217164 | A1 | * | 9/2011 | Cot | 415/223 |

OTHER PUBLICATIONS

Kolowa 1 Brochure, available at least by Mar. 6, 2004.

Kolowa 2 Brochure, available at least by Mar. 6, 2004.

DEL-AIR Systems, Northwind Fans, Mar. 1999.

International Search Report and Written Opinion of the International Searching Authority mailed Jan. 18, 2013, in corresponding PCT/US2012/051731. (English translation provided.).

* cited by examiner

PLASTIC FAN SHROUD AND CONE ASSEMBLY AND METHOD

FIELD

The present teachings relate to ventilation systems, and particularly to housings for fans operable to be mounted in structures.

BACKGROUND

Various structures can use ventilation systems to maintain a selected environment. The ventilations systems can help ensure that a supply of fresh air and acceptable levels of various materials are maintained within the structure. Further, the ventilation system can assist in removing less desirable compounds, such as carbon dioxide emitted by the inhabitants from the building. Therefore, the ventilation system may be used to move volumes of air and may generally include various fan systems to move the air.

Exemplary structure can include farmhouses that may require ventilation systems. Farmhouses may be any appropriate building generally used in the production or carrying out of farming activities. For example, farmhouses may include buildings used to house and/or brood chickens, house pigs, or other livestock. Generally, these farmhouses may cover a selected square footage to allow for collecting a selected number of the livestock in a selected area for various purposes, such as growth, brooding, culling and the like. These farmhouses may generally be sealed or substantially closed structures to ensure the ability to obtain a tightly controlled environment within the farmhouse. The ventilation systems, therefore, may play a role in maintaining the selected environment. For example, the ventilation systems may assist in removing various by-products, such as respiration gases and gases emitted by animal waste, from the structure to ensure a clean supply of air or assist in maintaining a selected temperature in the farmhouse. Therefore, achieving maximum efficiency of the ventilation system may be desirable.

SUMMARY

A fan may be a part of a ventilation system to control a part of an environment in a farmhouse. The fan may be used to move a selected volume of air at a selected rate, such as cubic feet per minute (cfm) to assist in removing selected gases from a farmhouse environment and introduce other selected gases into a farmhouse environment. For example, a fan may be used to move the respiration gases produced by the livestock kept in a farmhouse and replace it with atmospheric air. The fan system can include at least a portion of a housing that may be formed in a substantially monolithic or single piece manner. The monolithic fan housing may include a shroud for the fan, back draft damper doors, and a support for the doors.

The doors may assist in maintaining a low or non-existent airflow through the farmhouse at selected times. Further, the fan shroud may have as one piece or monolithically formed therewith the doors. A diffuser or cone can be attached to the shroud that may assist in creating a selected efficient airflow or rate. The diffuser, however, may be formed of a different material or same material as the shroud. For example, however, the diffuser can be substantially flexible. Therefore, the diffuser may have a formed size but may be flexed during installation to achieve an installation without substantially decreasing the efficiency of the diffuser. Also, the back draft doors may be assembled and operated with a door operating system to open the doors to achieve a maximum or high efficiency airflow position when the fan is operating or in a substantially closed position when the fan is not operating.

According to various embodiments, a housing assembly for a fan portion is disclosed. The housing can include a shroud having a face-wall portion operable to be mounted between support members of a structure and an orifice wall extending from the face-wall portion and defines a passage through the orifice wall. The housing can further include a diffuser defined by a plurality of diffuser members configured to be interconnected, wherein each of the plurality of diffuser members includes a plurality of slots on a first side and a plurality of tabs on a second side opposite the first side, wherein the diffuser is operable to be connected to the shroud. Each of the plurality of diffuser members is substantially flat across a first major surface and a second major surface, where both the first major surface and the second major surface extend between the first side that includes the plurality of slots and the second side that includes the plurality of tabs at least prior to being interconnected with another of the diffuser members.

According to various embodiments, a housing assembly for a fan portion is disclosed. The housing can include a shroud having a face-wall portion operable to be mounted to a support member of a structure, the face-wall portion generally defining a geometric shape having at least a side and a corner adjacent to the side. A passage can be formed through the shroud. An orifice wall can extend from the face-wall portion around the passage and further defining the passage. The housing can define a transition radius from the face-wall portion to the orifice wall portion, wherein the transition radius includes a first transition radius at the side and a second transition radius at the corner. The first transition radius is smaller than the second transition radius.

According to various embodiments, a method of manufacturing a housing assembly for a fan portion is disclosed. The method can include forming a three dimensional monolithic shroud assembly. The monolithic shroud assembly can include a shroud having a face-wall that substantially defines a face-wall plane and an orifice wall extending from the face-wall in a first direction; a magnet pocket on an interior of the orifice wall, wherein the magnetic assembly pocket includes at least one open end to receive a magnetic assembly, a door operable to close a passage defined at least by the orifice wall; and a striker pocket on an exterior of the door, wherein the striker pocket is configured to contain a striker member. The method can further include separating the door from the shroud and reversing the door to position the exterior of the door to the interior to locate the striker pocket adjacent the magnet pocket on the interior of the orifice wall.

Further areas of applicability of the present teachings will become apparent from the description provided hereinafter. It should be understood that the description and various examples, while indicating the various embodiments of the teachings, are intended for purposes of illustration only and are not intended to limit the scope of the teachings.

BRIEF DESCRIPTION OF THE DRAWINGS

The present teachings will become more fully understood from the detailed description and the accompanying drawings, wherein.

DETAILED DESCRIPTION OF VARIOUS EMBODIMENTS

The following description of various embodiments is merely exemplary in nature and is in no way intended to limit the teachings, its application, or uses. Although the following teachings relate generally to a ventilation system used in a farmhouse, the system may be used in any appropriate application.

Figure 1:
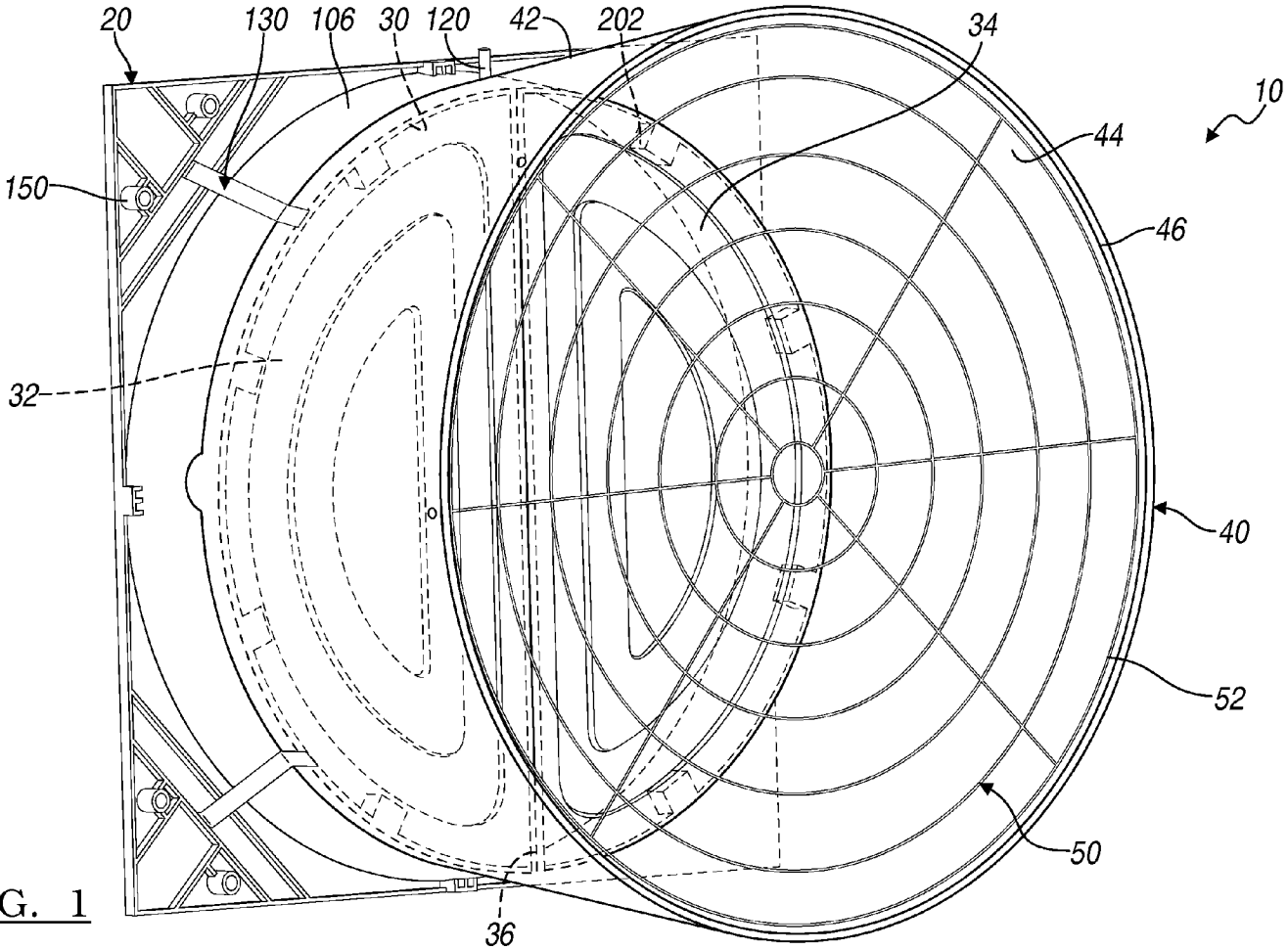
FIG. 1 is a perspective view of a diffuser side of a ventilation housing, according to various embodiments.
Figure 2:
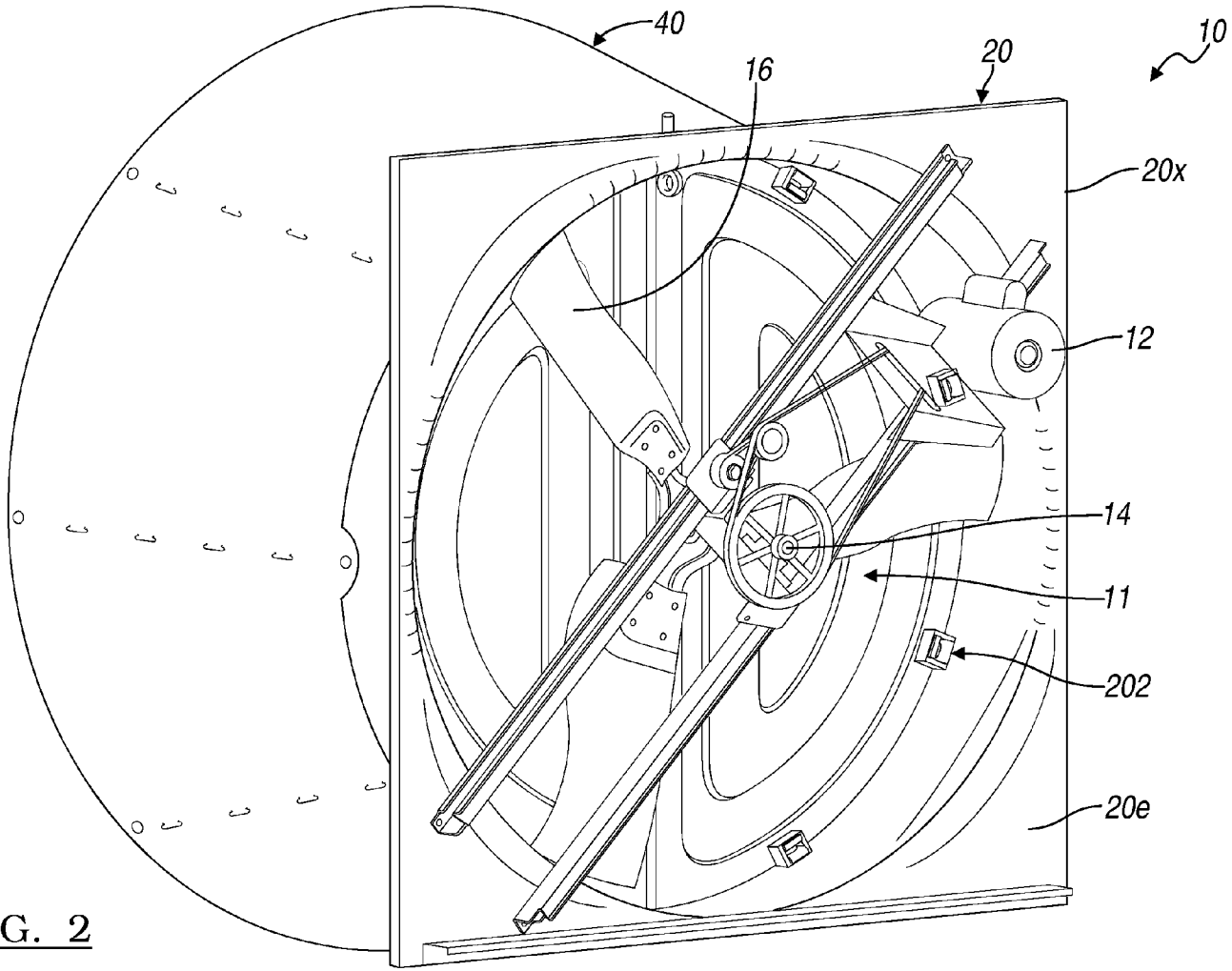
FIG. 2 is a perspective view of a fan side of the ventilation housing of FIG. 1.

With reference to FIGS. 1 and 2, a ventilation or fan housing assembly 10 is illustrated. The ventilation housing assembly 10 includes a fan portion or assembly 11 including a fan motor 12, a fan axle 14 and a plurality of fan blades 16. The fan portion 11 generally provides the motive force to move a selected volume of gas (e.g. air) at a selected rate. It will be understood that the amount of gas movable by the fan portion 11 may be dependent upon the power of the fan motor 12, the size and orientation of the fan blade 16 and other various portions. Regardless, it will be understood that the ventilation housing assembly 10 may be formed to any appropriate size, configuration and the like according to various embodiments.

Figure 6:
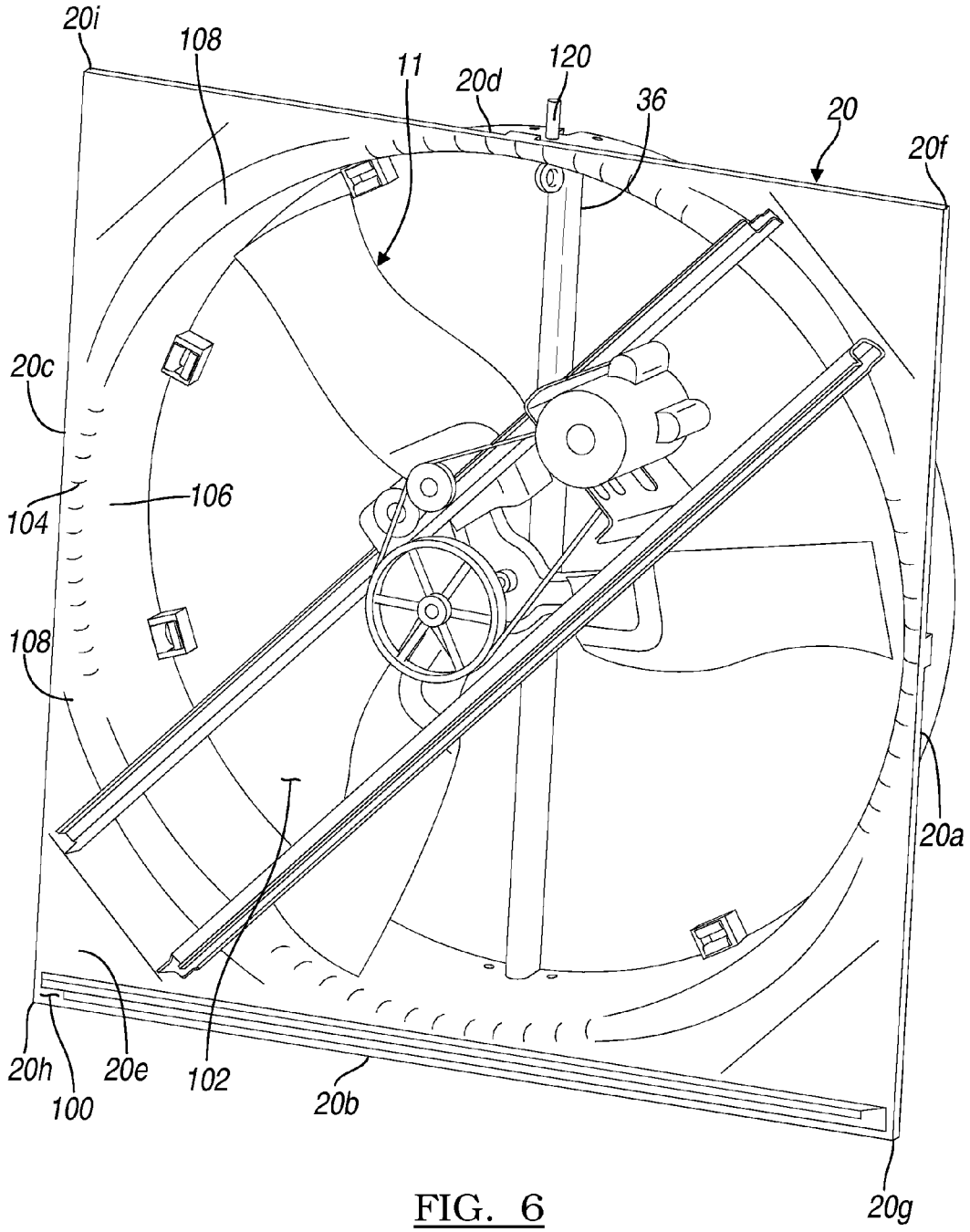
FIG. 6 is a perspective view of a shroud inlet side.

Regardless, the ventilation housing assembly 10 usually includes a shroud 20. The shroud 20 may be designed in any appropriate size for various sized fan portions 11, such as varying diameters of the blades 16. The shroud 20 may be substantially square or rectangular such that it may be installed in a structure, including between substantially vertically parallel studs or support portions. Therefore, the shroud 20 may generally define a geometric shape that can include four sidewalls 20*a*, 20*b*, 20*c*, and 20*d*. The four sidewalls 20*a*-20*d* provide an exterior support for a front or outlet sidewall or face-wall 20*e*. The outlet sidewall 20*e* generally defines an area substantially equivalent to an area defined by the various sidewalls 20*a*-20*d* and can also include a selected geometry to provide for various characteristics. For example, the sidewalls 20*a*-20*d* and face-wall 20*e* may be designed to create a substantially efficient airflow from the fan portion 11. Further, the shroud 20 is provided to support and may protect the fan portion 11 from various exterior environments such as weather, pests, and the like. Between or near the sidewalls 20*c*-20*d* are corners or connection sections 20*f*, 20*g*, 20*h*, 20*i* (as illustrated in FIG. 6).

The ventilation housing assembly 10 may also include a set of doors 30. The doors 30 may include a first door 32 and a second door 34 that are operable to close and substantially cover an opening defined at least by the front wall 20*e* of the shroud 20 and further through an orifice wall 106. The doors 30 may generally be assembled on a hinge or hinge post (as discussed further herein) that may be interconnected or extends from a support structure 36 that is a portion of or extends from the shroud 20. The shroud 20 along with the doors 30 and the support structures 36 may be formed substantially monolithically as a single piece, as described herein. When formed as a single piece, the doors 30 are separated from the shroud 20 via cutting or other separating mechanism or action. Alternatively, the doors 30 may be formed separately and later integrated into the shroud 20 at a later time, such as at the time of the installation of the shroud 20. Regardless, the doors 30 may be provided to cooperate with the remaining portions of the shroud 20 to substantially cover an opening to limit flow of air relative to the fan portion 11. As discussed herein, a magnetic and/or spring biasing system may also be provided.

Further assembled or integrated with the shroud 20 may be a diffuser 40. The diffuser 40 may include an exterior surface 42 and an interior surface 44. The interior surface 40 may be designed to assist in the aerodynamics of the fan portion 11 in moving the gas in a selected direction. Generally, the diffuser 40 is provided on a downstream side of the fan portion 11. Therefore, a flow of air is out through an external large outlet mouth side 46 of the diffuser. The inlet side of the diffuser 48 can be smaller and generally affixed to the shroud 20.

The diffuser 40 can be connected to the shroud 20 in any appropriate manner. For example, a plurality of fastening members 130 (FIG. 6), as discussed further herein, may be used to interconnect the diffuser 40 and the housing 20. Alternatively, or in combination thereto, a compression band or member may be used to interconnect the diffuser 40 with the shroud 20.

The diffuser 40 can be connected with a grille or cover 50. The grille 50 can generally be formed of a rigid material, such as an appropriate gage stainless steel or coated steel wire. Other appropriate materials are rigid plastics, such as glass-filled nylon, that can be formed into rod shaped portions. The grille 50 allows air to flow through, but does not allow large objects into the diffuser 40. The grille 50 may generally be positioned near the outlet end 46 of the diffuser 40 to assist in maintaining a substantially open airway through the diffuser 40. For example, the grille 50 can include in an outer rigid member 52 that is substantially near or in contact with the interior 44 of the diffuser 40. The outer member 52 can support the diffuser 40 substantially in a shape of the outer member 52. Thus, the outer member 52 can support the diffuser in a selected shape of the outer member 52. The outer member 52 can be annular or ring shaped and be similar in shape to other members of the grille 50.

Figure 3:
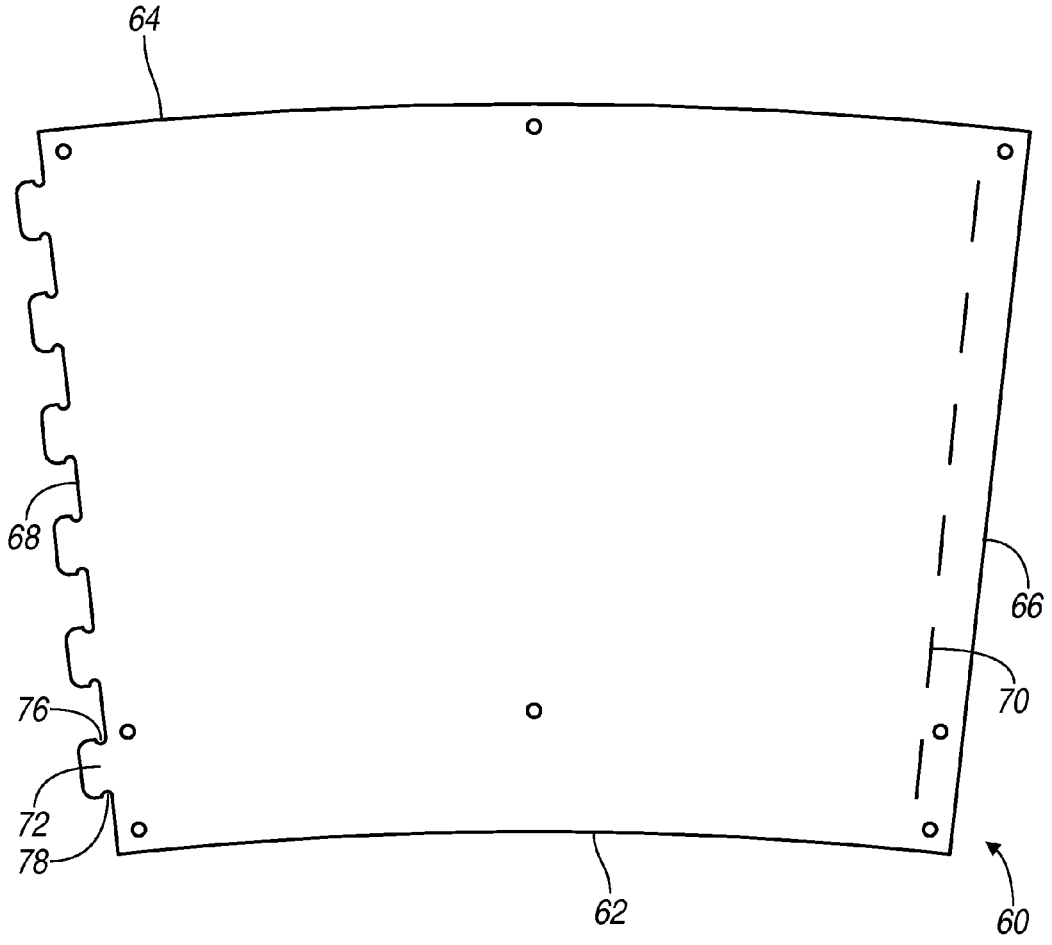
FIG. 3 is a plan view of a plan view of a diffuser panel.
Figure 4:
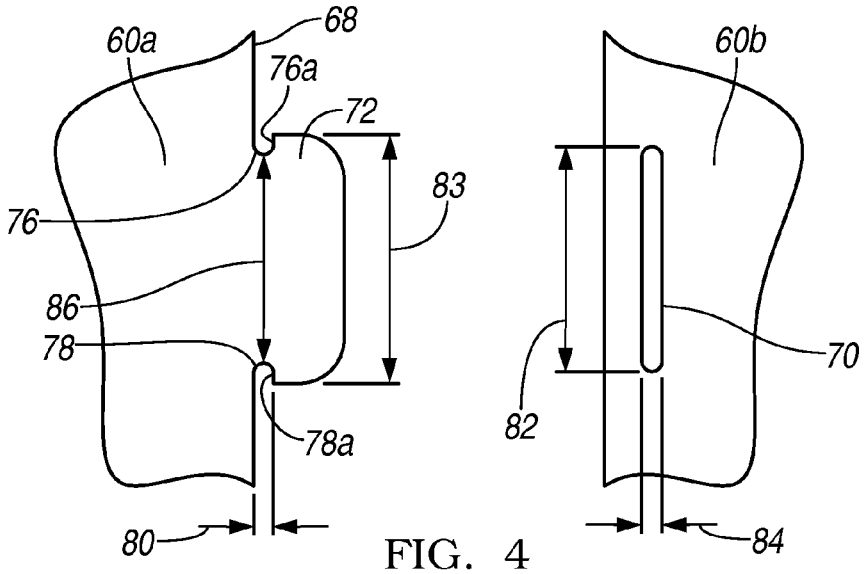
FIG. 4 is a detailed view of two diffuser panels illustrating a tab and slot configuration.

The diffuser 40 can be formed of a plurality of panels 60, as illustrated in FIGS. 3-5. The panels 60 can generally be formed or manufactured to be substantially planar, as discussed and illustrated here. The plurality of panels 60 are interconnected to form the substantially conical diffuser 40, as illustrated in FIG. 1, or other appropriate shape. The exact number of the panels 60 needed to form any selected diffuser cone 40 can be based upon the final diameter of the entrance or exit of the diffuser cone 40, the rigidity of the material of the diffuser cone 40, and other considerations. Nevertheless, each of the panels 60 can include a first side 62 that will be positioned near the shroud 20 after installation. The first side 62 can have a radius to assist in the installation, such as a radius of about 180 inches (in.) (about 457 centimeters (cm)) to about 250 inches (about 635 cm), including about 190 inches (about 482 cm) to about 230 inches (about 584 cm), and further including about 220 inches (about 560 cm) or about 0.5 meters. A second side 64 can define the outlet side and also include a radius. The radius of the outlet side 64 can be an appropriate radius such as about 210 inches (about 533 cm) to about 300 inches (about 762 cm), and further including about 220 (about 560 cm) to about 260 inches (about 660 cm), and further including about 255 inches to 260 inches (about 647 cm to about 660 cm) including about 0.6 meters.

The plurality of panels 60 can be interconnected in a series to form a substantially circular or annual orifice to define the cone of the diffuser 40. The first and second sides 62, 64 can be interconnected by third and fourth sides 66, 68, respectively. The third side 66 can have formed near an edge of the side 66, a plurality of slots 70. The number of slots can be any appropriate number of slots and be selected based upon a number of connections selected or desired to interconnect a plurality of the panels 60. The fourth or opposite side 68 can include a plurality of tabs 72. The tabs 72 can be dimensioned, as discussed further herein, to interconnect with slot 70 on sequential or next of the panels 60 (e.g. FIG. 5) in the series. Each of the panels 60 can be formed of a selected material that can include a selected flexibility of deformability to form the cone shape or the diffuser 40 and interconnect with other panels. The material can generally be a plastic material that can include appropriate properties of rigidity and flexibility for uses of the diffuser 40. Each panel 60, however, can generally be flat and define two flat major surfaces extending between the sides 66, 68.

With reference to FIG. 4, and continuing reference to FIG. 3, each of the tabs 72 or selected number of tabs 72 of a first panel 60*a* will be inserted into one slot 70 of a second respective panel 60*b*. Accordingly, two adjoining or sequential panels 60*a*, 60*b* can be interconnected via positioning the tab 72 through the slot 70 and interlocking the respective panels 60*a*, 60*b*. Each of the tabs 72 can extend from the second edge 68 a selected distance. On at least one and selectively both sides or ends of the tab 72 can be undercut or inwardly cut portions 76 and 78. The undercut portions can generally have a radius of about 0.01 in (about 0.25 millimeters (mm)) to about 0.5 inches (about 13 mm), and further about 0.01 in (about 0.25 mm) to about 0.05 in (about 1.3 mm), and further about 0.3 inches (about 7.6 mm) or about 0.7 cm. In addition, the undercut can define between the outer wall 72 and an undercut edge 76*a* and 78*a*, respectively, a distance 80. The distance 80 can be generally a distance that is in relation to the thickness of the material of the panel 60. For example, the distance 80 can be about two times the thickness of the panel 60. The slot 70 can include a length 82 and a width 84. The width 84 can be similar or equivalent to the distance 80 defined in the undercut 76, 78. The length 82 of the slot 70 can be similar or slightly longer than an undercut length tab length 86. Generally, the tab 72 can include a separate length 83 that is about equal to or greater than the length 82 of the slot 70. This allows the tab 72 to snap into or have an interference fit with an edge around the slot 70, as discussed herein.

Figure 5A:
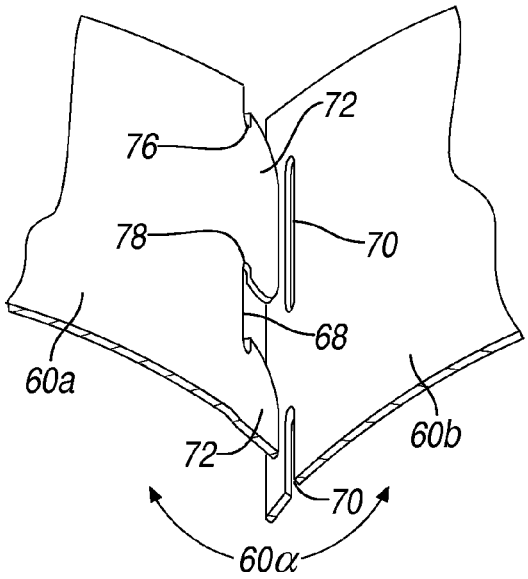
FIGS. 5A and 5B is a perspective view of a process of connecting two diffuser panels.
Figure 5B:
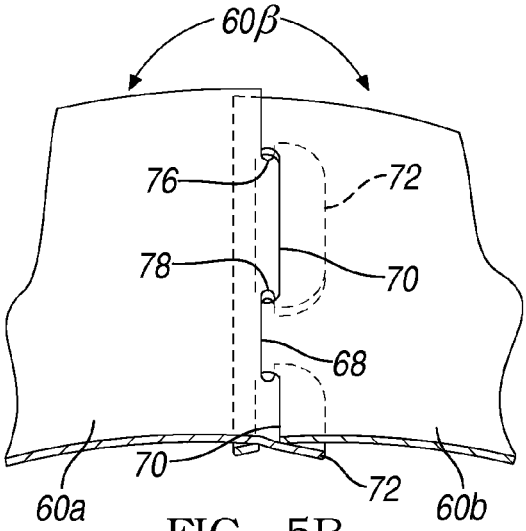

As shown in FIGS. 5A and 5B a tab from one panel 60*a* can be inserted into a slot 70 in another panel 60*b* with the panels at about a 90° angle 60α relative to each other. The tab 72 snap into each slot 70 and lock into place as the panel 60*a*, 60*b* are rotated from the 90° position in the direction of arrow 60β to about parallel positions, as shown in FIG. 5B. Again, a selected number of the panels 60 can be interconnected to form the diffuser cone 40. A selected number of panels can include about 4. The tabs 72 can be positioned on the exterior of the completed cone 40 or on the interior of the cone 40, as selected.

Each of the panels 60 can be formed via separate molding or by die cutting from a selected single extrusion sheet. For example, a selected sheet of material can be extruded including selected dimensions, such as a thickness (e.g. a thickness of about 1.5 mm to about 3.0 mm.) Once a sheet has been extruded, an appropriate number of panels 60 can be die cut from the sheet of extruded material. Each of the panels 60, therefore, can then can be stacked and shipped in a substantially flat manner to a selected installation site. A plurality of panels 60 can be bundled into a package for shipping such as a number necessary for a single housing assembly 10 or a number for a selected number of housing assemblies 10. In addition, the installation and assembly of the panels 60 can be substantially tool-free as the tab 72 is positioned within the slot 70 for interconnection of the plurality of panels 60. The assembled cone 40 can be connected with the shroud 20, as discussed further herein (FIG. 6). Additionally, the materials, such as the plastic or other selected polymers, to form the panel 60 can be substantially non-corrosive materials (e.g. resistant to UV, heat, cold, etc.) to provide for a selected longetivity. Additionally, the tab and slot interconnection can provide for a substantially strong interconnection of the selected plurality of panels 60 without the need for additional tools or fasteners. As discussed above, the outer member 52 can selectively position the diffuser cone 40 and the panels 60 that form the diffuser cone 40 in a selected position or orientation after installation.

With reference to FIG. 6, an inlet side 100 of the shroud 20 can generally be formed to include a selected orifice 102 through which the fan assembly 11 can be operated to move a volume of gases through the face-wall 20*e* of the shroud 20. Support 36 can be generally formed near an outlet side of the shroud 20. The orifice 102 can be formed to include a size that allows for the fan assembly 11 to be positioned within the shroud 20 and still rotate freely when operated.

The shroud 20 or the face-wall 20*e* can include a variable transition radius that can allow for a maximization of a diameter of the orifice 102 which minimizes the overall dimensions of a support flange 20*x* of the shroud. Also, the greater the transition radius, as discussed herein, can increase efficiency of the shroud 20 for the movement of gas through the shroud 20. Generally, the variable radius can include a selected first transition radius 104 substantially near the four sidewalls 20*a*-20*d* of the shroud 20. The first radius 104 can be a radius defined between the flat face or face wall 20*e* and an internal wall 106 that defines the orifice 102. The radius 104 adjacent the side walls can include a selected radius such as about 0.01 inches (about 0.25 mm) to about 1 inch (about 25 mm), and further about 0.01 inches (about 0.25 mm) to about 0.5 inches (about 13 mm), and further about 0.1 inches (about 2.5 mm) to about 0.2 inches (about 0.5 mm). The side wall radius 104 can be the radius that is defined adjacent the side wall portions 20*a*-20*d* between the face wall 20*e* and the orifice wall 106. The side wall radius 104 can be smaller, including substantially smaller, than a second transition radius also referred to as a corner orifice radius 108 that is defined or formed near the four corners 20*f*-20 *i* of the shroud 20. The side wall radius 104 transitions to the corner radius 108. The corner radius 108 can be about 1 inch (about 25 mm) to about 5 inches (about 13 cm), further including about 2 inches (about 5 cm) to about 4 inches (about 10 cm), and further including about 3 inches (about 8 cm) to about 3.5 inches (about 9 cm). The corner wall radius 108, however, is defined as a radius between the face wall 20*e* and the orifice wall 106 adjacent the corner.

Accordingly, the side wall radius 104 can be substantially smaller than the corner wall radius 108. For example, the side wall radius 104 can be about 10-30 times larger than the side wall radius, including about 15-25 times larger than the side wall radius, and further including about 20 times larger than the side wall radius. Also, a center of the sidewall radius 104 can be angularly offset from a center of the corner radius 108 by an appropriate amount, such as about 10 degrees to about 90 degrees around the orifice 102.

By including the small side wall radius 104 relative to the large corner wall radius 108 the orifice size, including an area defined by the orifice 102 can be maximized while minimizing a side wall dimension of the shroud 20. Accordingly, the shroud 20 can be formed to fit within a structure having center supports or studs at 60 inches center while being able to house a 57 inch diameter fan portion 11. In addition, maximizing the area of the orifice 102, the radius 108 maximizes airflow and efficiency of the fan portion 11 through the shroud 20. Accordingly, including the variable radius orifice, such as including a side wall radius 104 that is different than the corner wall radius 108 can allow an increase in orifice area and gas flow efficiency while reducing overall dimensions of the support flange 20*x*.

Figure 7:
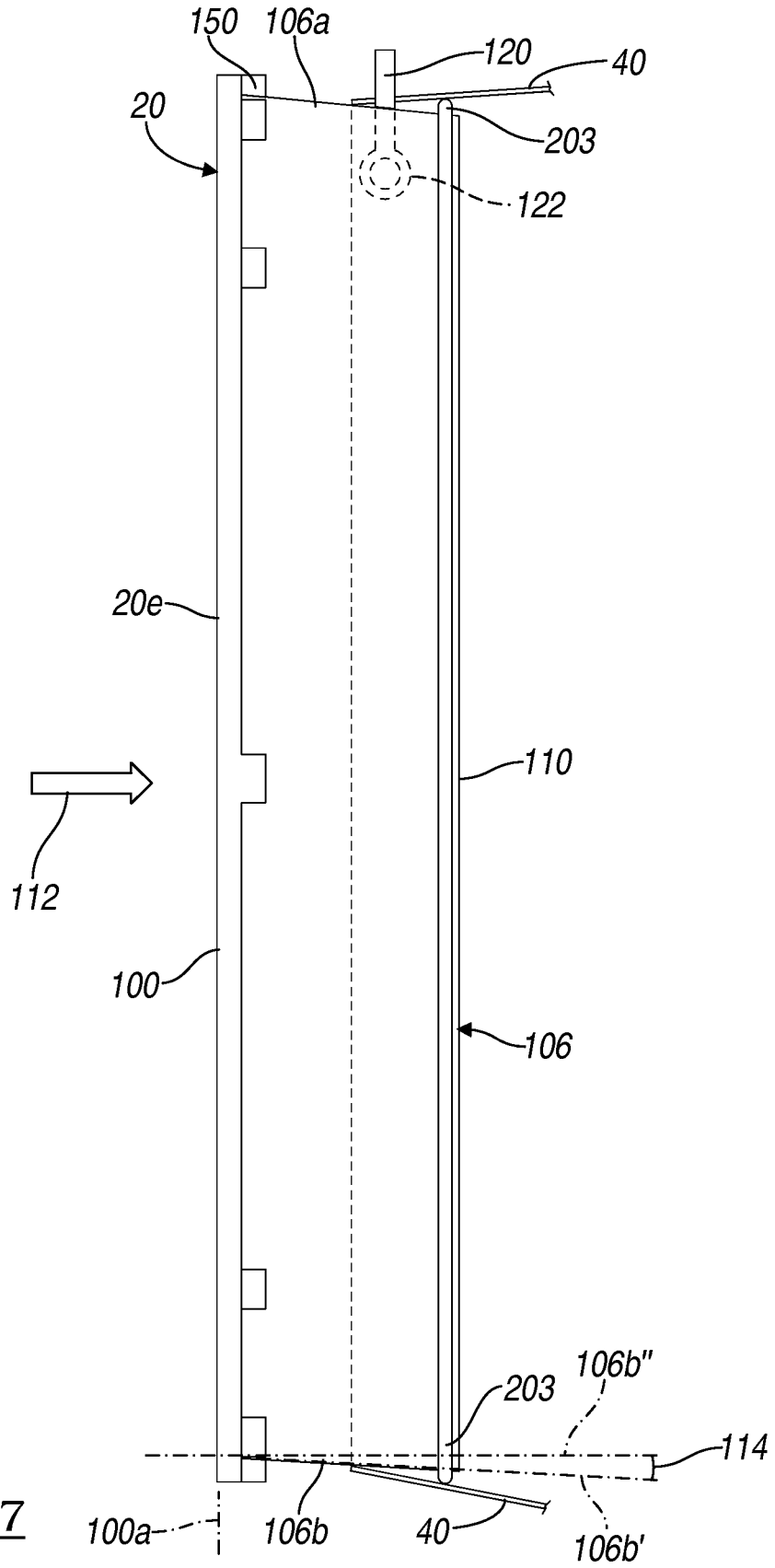
FIG. 7 is a side plan view of a diffuser and orifice wall.

With reference to FIG. 7, the shroud 20 has the inlet side or face 20*e* and an outlet side 110 such that when the fan portion 11 is operating gas is flowing generally in the direction of arrow 112. The orifice wall 106, can slope downward at a selected angle 114. The angle 114 can be defined as an angle between a line 106*b*' that extends from a bottom wall 106*b* of the orifice 106 that extends at the angle 114 relative to a line or plane 106*b*" in a substantially perpendicular to a line or plane 100*a* defined by the face wall 20*e* of the shroud 20.

A top of the shroud wall 106*a* is positioned generally further away from the center of gravity, or surface of the earth, after the installation. Accordingly, the bottom 106*b* of the orifice wall 106 is the position nearest the ground or earth surface. The angle 114 allows for flowable material, such as rain, condensation, and other materials to flow away from the inlet face 20*e* and toward the outlet side 110 of the shroud 20. As illustrated in FIGS. 1 and 2, and discussed further herein, the diffuser 40 is connected with the shroud 20, and generally to the orifice wall 106. Accordingly, the diffuser 40 can also include at least a portion of the angle 114. Thus, flowable materials can flow away from or out of the assembly 10 and not into a structure into which the assembly 10 is installed. Additionally, additional holes or passages need not be provided in the orifice wall 106 or the diffuser 40 to allow material to drain out of the shroud 20 or the diffuser 40. Rather, the angle 114 can position the orifice wall 106 and the diffuser 40 such that material will flow out of the shroud 20 and the diffuser 40 under the force of gravity.

The angle 114 can be an appropriately selected angle. For example, the angle 114 can be about 0.05 degrees to about 10 degrees, further including about 0.5 degrees to 5 degrees, and further including about 2 degrees. The angle 114 can generally be provided to resist a flow of flowable material towards the inlet wall or face 20*e* and towards the outlet side 110, but without substantially interfering with a flow of gases through the housing assembly 10 during an operation of the fan portion 11. Accordingly, the angle 114 can be selected to be about 1 degrees to about 2 degrees, including about 2 degrees, to allow for a gentle angle so that material will flow away from the inlet side 100 of the shroud 20 but not so steep as to cause interferences in the airflow such as vortices and sharp directional changes, during operation of the fan portion 11.

The shroud 20, as discussed above and illustrated in FIGS. 1 and 2, is connected with the diffuser 40. The diffuser 40, during installation or as a portion of the installation process, can be interconnected with the orifice wall 106 defined or extending from the shroud 20. The orifice wall 106 can include an internal surface that is positioned near the fan portion 11 and the doors 30, as discussed further herein. The doors 30 are generally positioned such that they will be within the diffuser 40 during operation of the fan portion 11. Accordingly, the diffuser 40 is mounted and affixed to an exterior of the orifice wall 106.

Figure 13A:
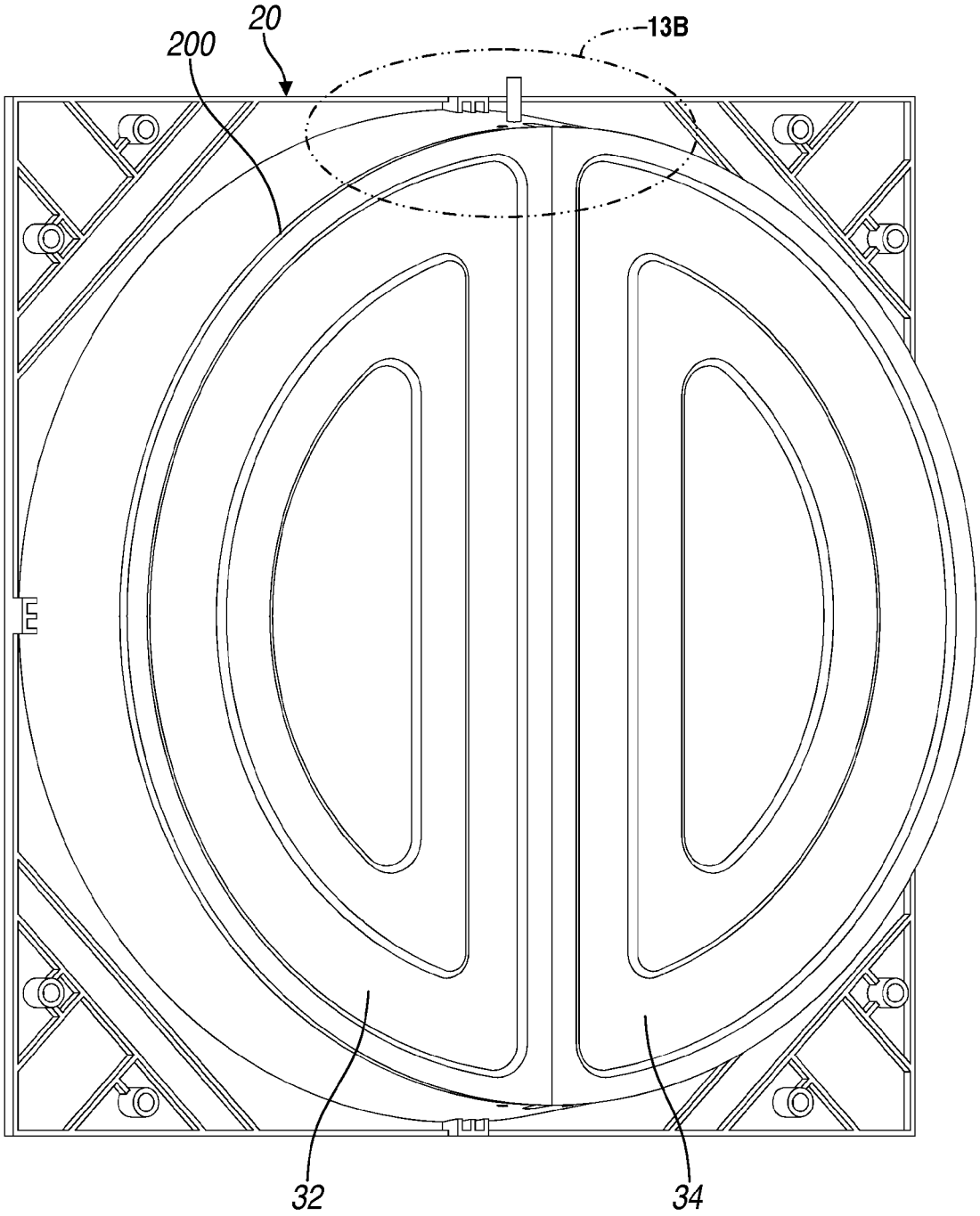
FIG. 13A is a perspective view of a shroud and door formed as a single piece from an outlet side.
Figure 13B:
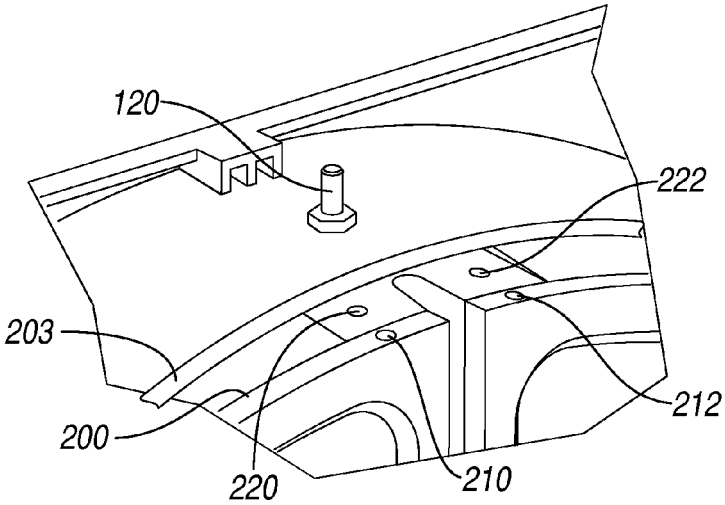
FIG. 13B is a detail view of FIG. 13A.

A sealing or spacer member 203 can be positioned around an exterior of the orifice wall 106, as illustrated in FIG. 7 and FIG. 13B. The spacer member 203 can be formed or shaped into a ring to match a circumference of the orifice wall 106. The spacer member 203 can be formed of a material having an appropriate dimension, such as an external diameter of about 0.7 in. The circumference of the spacer member 203 can generally match the external circumference of the orifice wall 106. The diffuser 40 can be mounted over the spacer member 203. The spacer member 203 can, therefore, reinforce and make more rigid the shape of the orifice wall 106. Further, the spacer member 203 can ensure appropriate clearance for movement of the doors 32, 34 into the volume defined by the diffuser 40.

A locating bolt or member 120 can be positioned to extend through the orifice wall 106. The centering member or bolt 120 can be positioned substantially during the formation or prior to shipping of the shroud 20 and can be positioned at a center of the orifice wall 106. Alternatively, the member 120 can be positioned during assembly. The centering bolt 120 can be positioned to extend substantially in-line with the support structure 36 or generally parallel to the support structure of the building into which the shroud 20 is installed.

The centering bolt 120 can engage a portion of the diffuser 40, such as a centering hole or passage 122. A centering hole 122 can be formed through at least one of the panels 60 that is formed into the diffuser 40, as discussed above. A centering hole 122 can allow the diffuser 40, once assembled including the plurality of panels 60, to be positioned and held relative to the shroud 20. The centering bolt 120, therefore, can at least preliminarily or efficiently hold the diffuser 40 relative to the shroud 20 during installation of additional fasteners or fixation elements, such as a fastening strap or bolt 130.

The fastening strap 130 can engage the diffuser 40 at a diffuser engaging portion 132. A plurality of rivets, bolts, or other fixation portions can hold the fastener 130 to the diffuser 40. The diffuser or fastener 130 can be further bolted or riveted or otherwise engage the shroud 20 at a shroud engaging end 134. An appropriate number of the diffuser fasteners 130 can be provided to substantially fix or initially fix the diffuser 40 relative to the shroud 20 for operation of the fan portion 11. Nevertheless, during an initial installation the centering bolt 120 can assist in holding diffuser 40 in place while positioning of the diffuser fasteners 130. Thus, the centering bolt 120 can assist in allowing for a substantially single person assembly of the diffuser 40 to the shroud 20 by holding the shroud in a selected location and to the shroud 20 during installation of the diffuser 40.

Figure 9:
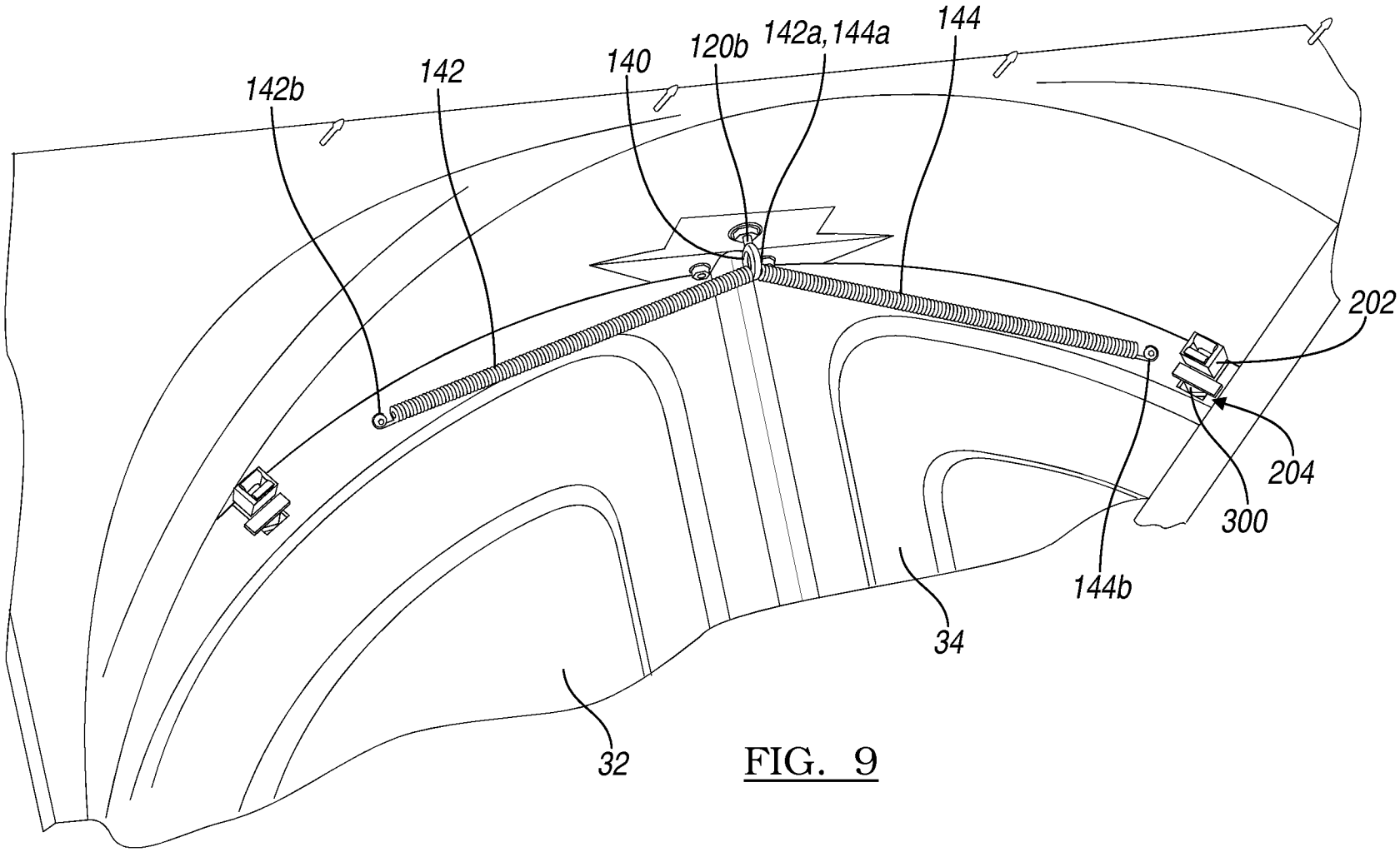
FIG. 9 is an internal detail view of an inlet side of a diffuser with doors in a closed orientation.

With additional reference to FIG. 9, the centering bolt 120 can include a second end 120*b* that extends to an interior of the orifice wall 106. The second end 120*b* of the centering bolt 120 can include a connection, such as an eye-ring or eye-let 140 that can be interconnected with a door closing member or a system that can include a first door closing spring 142 and a second door closing spring 144. Each of the door closing springs 142, 144 can include first ends 142*a*, 144*a*, respectively, that interconnect with the eye-let 140. Respective second ends 142*b*, 144*b* can connect with the two doors 32, 34 to bias the doors 32, 34 in a closed position that places them substantially in contact with the outer or outlet edge of the orifice wall 106. The two springs 142, 144 can both engage the single eye-let 140 that is a portion of or connected to the centering bolt 120. Accordingly, a single member, including the centering bolt 120 can be positioned to assist in installation and centering of the diffuser 40 and for the door closing system including the biasing springs 142, 144. It is understood, however, that the door closing or biasing system can include biasing members other than springs, such as the coil springs 142, 144, and other positioning features including the door positioning system disclosed in U.S. Pat. No. 7,611,403, incorporated herein by reference.

Figure 10:
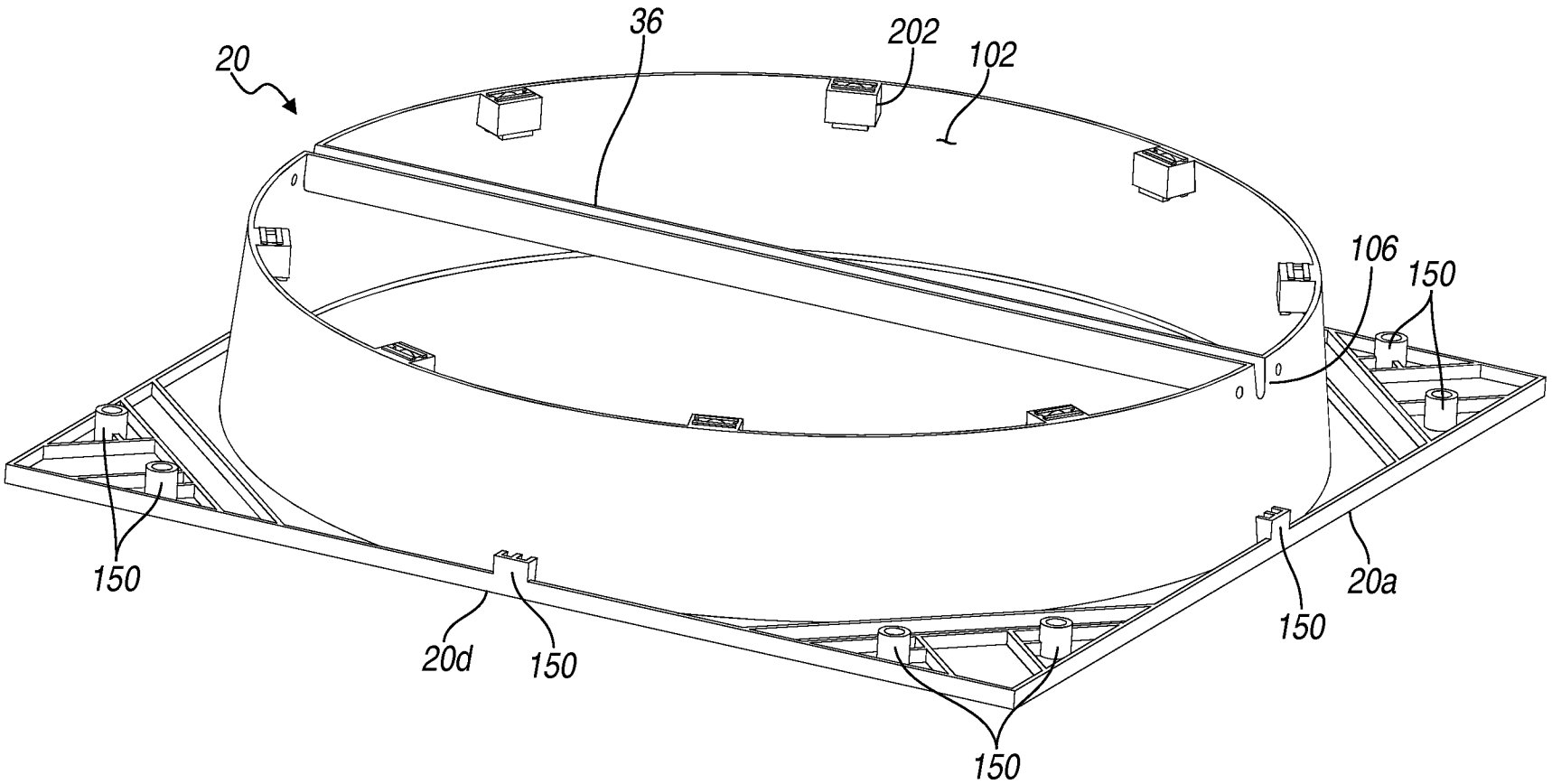
FIG. 10 is a perspective view of a shroud and orifice wall.
Figure 11:
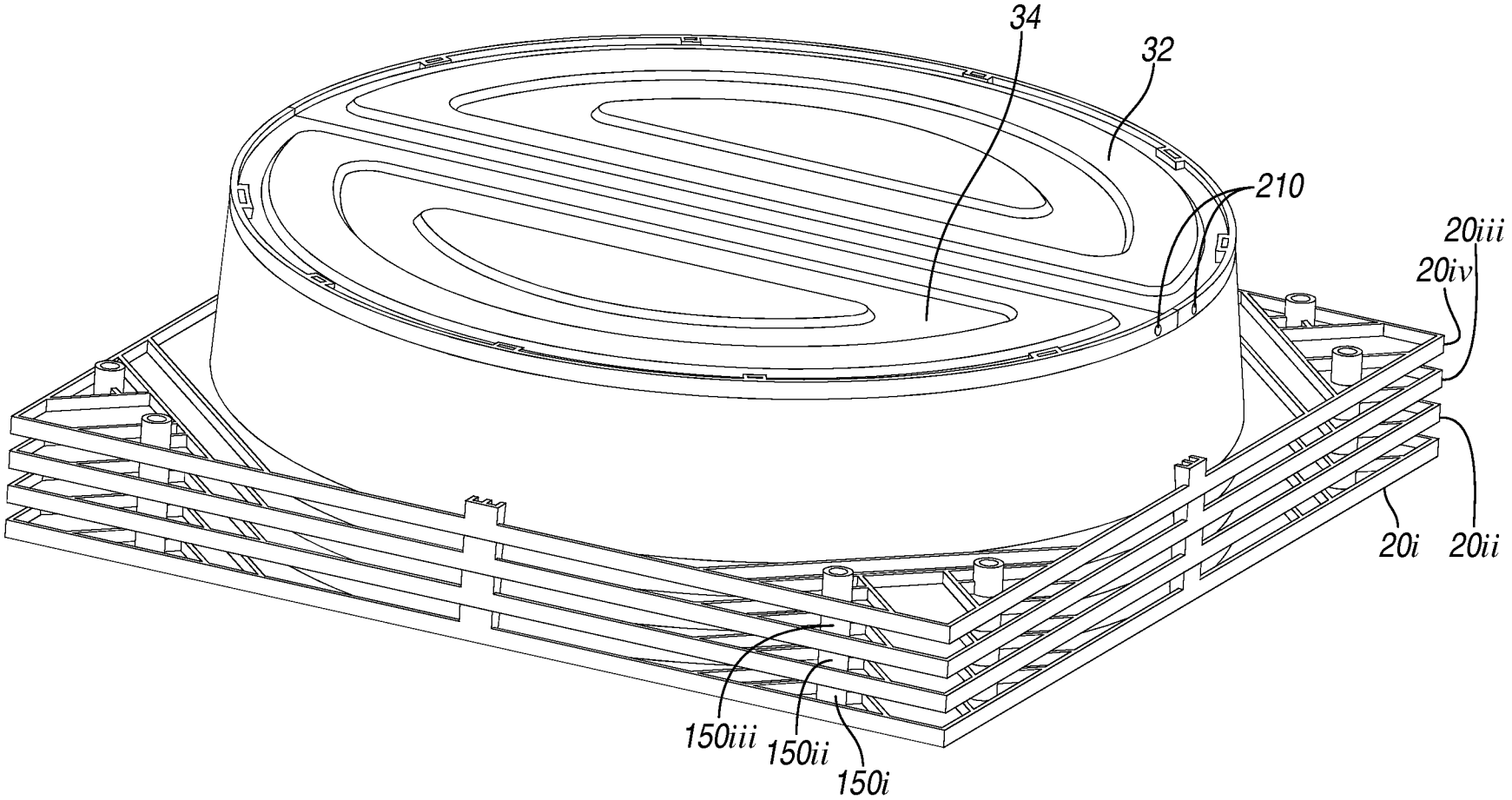
FIG. 11 is a perspective view of a stack of shroud and door members.

With reference to FIGS. 10 and 11, the shroud 20 and the orifice wall 106 can be formed as a part of the shroud 20 to assist in compact stacking for packing of plurality of the shrouds 20. Accordingly, the centering bolt 120 need not be installed prior to stacking the shrouds, as illustrated in FIG. 11 but a hole can be formed in the orifice wall 106 to receive the centering bolt 120 during formation or after formation of the orifice wall 106. The shroud 20 can be individually formed, such as via injection molding, blow molding, vacuuming molding, or other appropriate molding methods. As illustrated in FIG. 10, however, the shrouds 20 can be formed substantially individually for later packing or stacking for transportation.

With further reference to FIG. 10, the shrouds 20 can be formed to include a plurality of spacers 150 positioned around the orifice 102. The spacers 150 can be included to provide any appropriate height or spacing distance between a plurality of shrouds 20 that are stacked upon each other, as illustrated in FIG. 11. For example, a height of the spacers 150 can be about 2 inches (about 5 cm) to about 3 inches (about 7 cm) in height including about 2 inches (about 5 cm) in height. Thus, a number of shrouds, such as about 6 shrouds, can be stacked in about a 1 foot (about 30 cm) high container, not considering a height or depth of the orifice wall 106 that can be selected. Additionally, the spacers 150 can be formed with the shroud 20, such as one piece with the other portions of the shroud 20, during a formation of the shroud 20. Thus, the one piece spacers 150 negate any additional spacer that may required or selected for stacking the shrouds for transportation or storage after forming the shrouds 20.

Additionally, the orifice wall 106 can define a taper that tapers away from the outside edge or wall 20*a*-20*d* of the shroud 20. Accordingly, the shroud wall 106 can taper towards a center of the shroud 20. The taper of the orifice wall 106 can be a selected taper such as about 0.01 degrees to about 5 degrees, including about 1 degrees to about 4 degrees, and further including about 3 degrees. The taper of the orifice wall 106 can allow for an ease and compactness of stacking of a plurality of the shrouds 20, as illustrated in FIG. 11. For example, about 13 shrouds 20 can be stacked within a height of about 35 inches.

Illustrated in FIG. 11 are shrouds 20*i*, 20*ii*, 20*iii*, 20*iv*. The four shrouds 20*i*-20*iv* are stacked substantially tightly on top of one another, such that they are substantially only spaced apart via the spacers 150 between the plurality of the shrouds 20*i*-20*iv*. The spacers 150-150*iii* allow for ease of removal of the various shrouds 20*i*-20*iv* from the nested stack. Additionally, as illustrated in FIG. 11, the doors 32, 34 can be positioned on the orifice wall 106 and stacked between the shrouds 20*i*-20*iv*. The shroud wall 106 can include a magnet pocket 202 for holding a magnetic assembly, as discussed herein, and the doors 32, 34, can include a striker pocket 204 for holding a striker, as discussed herein. The respective striker 300 and magnetic assembly can help hold the doors 32, 34 relative to the shroud 20 when stacked.

The doors 30, including the first and second doors 32, 34 can be formed to connect with the shroud wall 106, as discussed further herein. The doors 32, 34 can be molded or otherwise formed with the remaining portion of the shroud 20 as a single piece or also referred to as a monolithic piece, for example with vacuum molding, injection molding, or other appropriate molding techniques. The doors 32, 34 can then be cut away from the remaining portions of the shroud 20 and reconnected in an operable manner, such as via axle or hinge pins, as discussed further herein.

Figure 12:
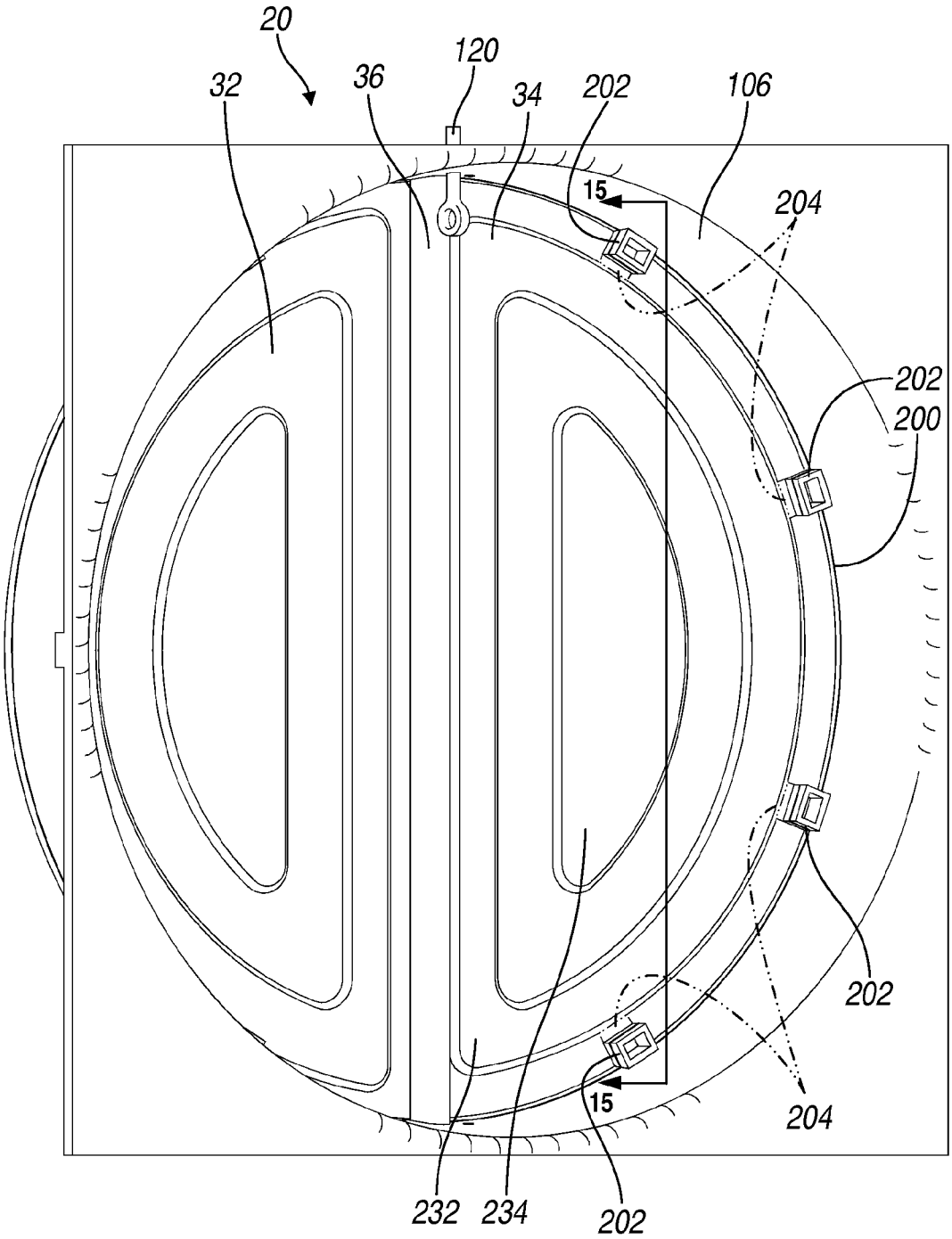
FIG. 12 is a perspective view of a shroud and door formed as a single piece from an inlet side.

As illustrated in FIG. 12, the shroud 20 can be molded or formed as one piece to include the doors 32, 34 and further include the support structure 36. The support structure 36 can assist in maintaining the dimensions of the orifice wall 106 after installation and operation of the fan portion 11. The doors 32, 34 can be molded, however, as a single piece with the shroud 20. The shroud 20 can be formed with a break away or cut away line 200. The cut line 200 can be a perforation or guide line to assist in cutting the doors 32, 34 from the orifice wall 106. Alternatively, the formed shroud 20 with the doors 32, 34 can be placed with a jig or fixture to cut the doors 32, 34 from the shroud 20. Therefore, the doors 32, 34 can be formed as a single piece with a remaining portion of the shroud 20 for ease of manufacturing and reduction in manufacturing steps and material costs.

Additionally, the orifice wall 106 can be formed to include closure pockets or magnetic assembly pockets 202, as discussed further herein. The magnetic assembly pockets 202 can be formed in or on the orifice wall 106 to be substantially aligned with striker plate pockets 204 formed in the doors 32, 34. The striker plate pockets 204 can be aligned with the magnetic assembly pockets 202 during operation to assist in maintaining closure of the doors 32, 34 relative to the orifice wall 106, again as discussed further herein.

As illustrated in FIGS. 12 and 13A, when the doors 32, 34 are formed with the shroud 20 the striker pockets 204 can be formed on an exterior of the shroud/door assembly, as illustrated in FIG. 13A. The magnetic assembly pocket 202, however, is formed on an interior of the orifice wall 106, as illustrated in FIG. 12. Accordingly, once the doors 32, 34 are separated from the remaining portion of the shroud 20, the doors 32, 34 can be flipped or turned over such that the striker pockets 204 will face or contact the magnetic assembly pockets 202. This allows the striker pockets 204 to include complex geometries that are efficiently formed by having the striker pockets 204 be on an exterior of the orifice wall 106 to efficiently manufacture the striker pockets 202 in the doors 32, 34.

Figure 14:
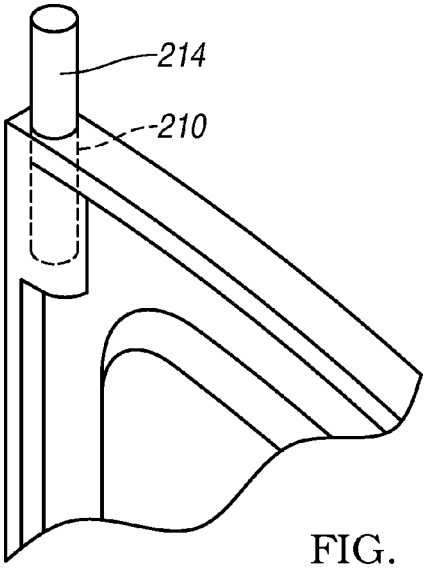
FIG. 14 is a detail view of a door with a hinge pin positioned therein.

Additionally, each of the doors 32, 34 can be formed to include a first or upper hinge pin hole 210 and a lower or second hinge pin hole 212. Thus, a pair of the holes 210, 212 can be formed in each of the doors 32, 34 and each of the holes 210, 212 for receipt of a hinge pin 214, as illustrated in FIG. 14. Thus, each of the doors 32, 34 can include two of the hinge pins 214. Each of the hinge pins 214 can be positioned in an appropriate one of the holes 210, 212 and further positioned in appropriate hinge pin holes 220, 222 in the orifice wall 106 or formed in a bracket connected to the orifice wall 106. By having a hinge pin 214 at both ends of the doors 32, 34, and being positioned within respective two hole or pair of holes 220, 222 in the orifice wall 106, the doors 32, 34 can pivot about the hinge pins 214 in a generally understood manner. It is further understood that the hinge pins 214 can interconnected with the orifice wall 106 via a separate bracket that is connected to and/or extends from the orifice wall 106 to receive the hinge pins 214. Generally, a bracket can be connected to the shroud wall 106, such as via the holes 220, 222. The hinge pins 214, which can be placed in the doors 32, 34, can be connected with the bracket on the shroud wall 106. The doors 32, 34 generally pivot near the support 36 to open into the diffuser 40, once installed, and generally in a downstream direction relative to the fan portion 11.

Figure 15:
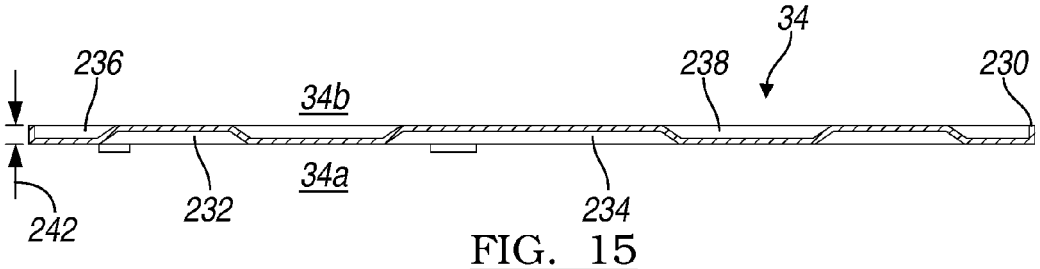
FIG. 15 is a cross-sectional view of a door member.
Figure 19:
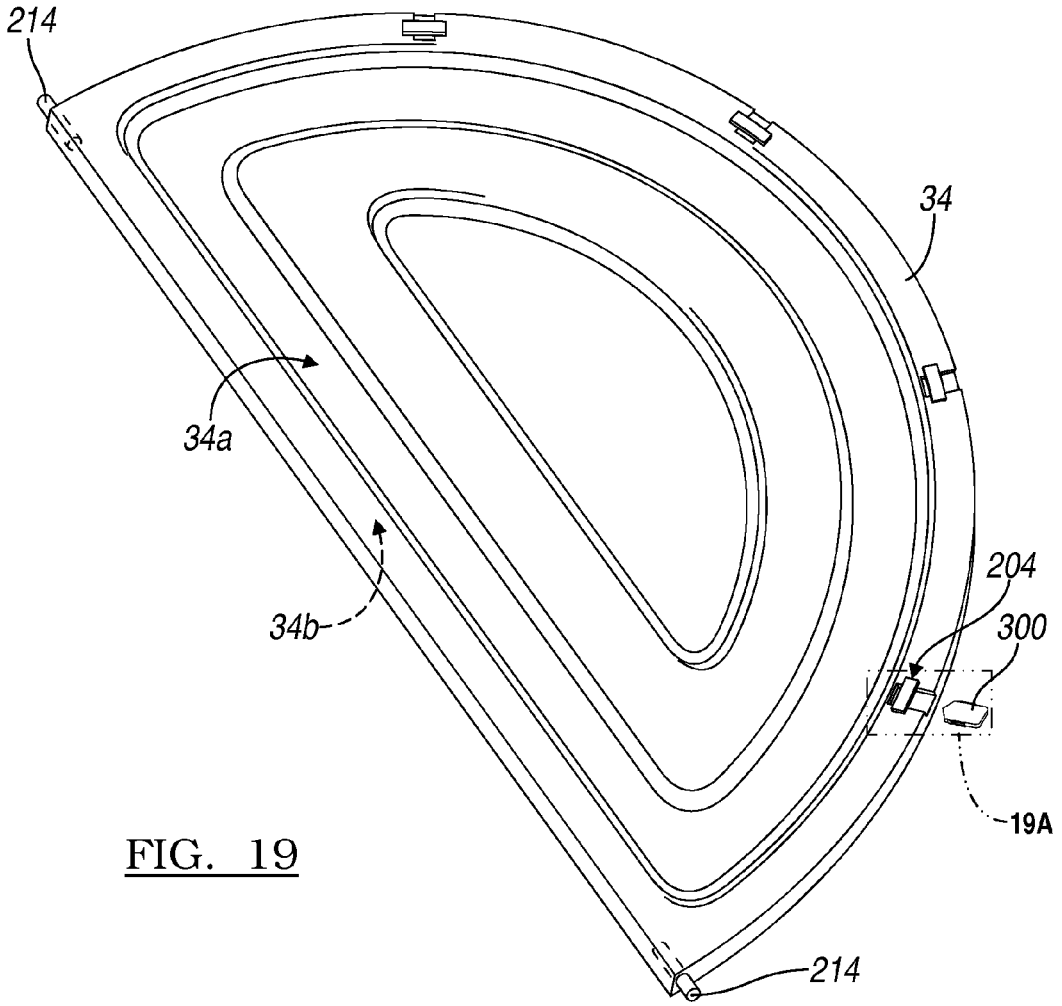
FIG. 19 is a plan view of a door member including a striker plate pocket.
Figure 19A:
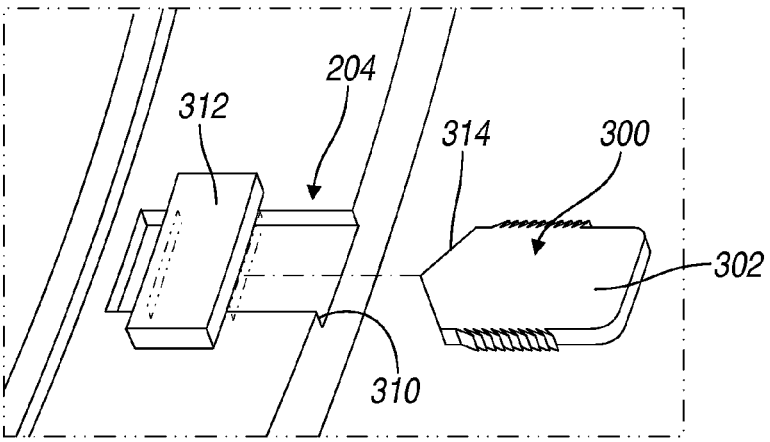
FIG. 19A is a detail view from within circle 19A of FIG. 19.

With continuing reference to FIG. 14 and further reference to FIGS. 15 and 19, the doors 32, 34 can also be molded to include a selected cross-section. As illustrated in FIG. 15, a cross-section of the door 34 can include a cross-section that includes peaks or high portions and valleys on either side of the door 34. It is understood that either or both of the doors 32, 34 can include the discussed structure, although the following discussion references the door 34 only. Although the door 34 may be substantially flat, such that it can lay flat on a surface, the cross-section of the door 34 can include a selected design or structure to assist in stiffening or providing rigidity of the door 34 without additional reinforcement rods or braces.

The door 34 can include an upstream side 34*a* (a side that contacts the shroud or is nearer the fan portion 11) and a downstream side 34*b* (faces away from the shroud 20). On the downstream side 34*b* an outer ridge or lip 230 can generally be formed around an exterior edge of the door 34. A first rib portion in substantially an "open D" pattern 232 can be formed a first distance in from the exterior lip 230. The first ribbed portion 232 can form a peak relative to the outlet side 34*b* of the door 34. A second raised or ribbed portion 234 can generally define an inner or "closed D" and further define a peak relative to the downward or outlet side 34*b* of the door 34. The two raised portions 232, 234 define an outer valley 236 and an inner valley 238 relative to the outlet side 34*b* of the door 34. Accordingly, the door 34 can be formed to include a "double D" or "open and closed D" ribbed configuration that includes alternating peaks and valleys relative to either of the inlet side 34*a* or the outlet side 34*b* of the door 34. The double D pattern can generally imitate the external perimeter shape of the door 34.

Thus, while a thickness of the material of the door panel 34 can be a selected dimension, such as about 2 mm to about 4 mm, an overall cross-sectional thickness 242 of the door 34 can be formed that is greater than a thickness of the material from which the door 34 is created or formed. The cross-sectional thickens 242 of the door 34 can be selected to be about 0.1 inches (about 0.21 cm) to about 1 inches (about 2 cm), further about 0.2 inches (about 0.5 cm) to about 0.8 inches (about 2 cm), and further about 0.5 inches (about 0.1 cm). Thus, the cross-sectional thickness 242 of the door 34 can be formed to provide a selected stiffness or rigidity of the door 34 for operation of the door 34 after installation of the door 34 without additional braces or stiffening rods.

As discussed above, the closure or magnetic assembly pocket 202 formed in the orifice wall 106 can be assembled to include a magnet for assisting in closing the doors 32, 34. A striker plate or portion 300 (FIG. 18) can be fit in a striker pocket 204 formed in the doors 32, 34. The assembly or connection of the magnetic and striker portions can be assembled in various embodiments, as discussed further herein. Generally, the magnet positioned in the magnetic assembly pockets 202 can magnetically adhere, with a selected force, the striker portion 300 positioned in the striker pocket 204 of the doors 32, 34. The magnet and striker interaction can assist in holding the doors 32, 34 in the closed position when the fan portion 11 is not operated. This can assist in maintaining a closed position of the doors, 32, 34 to maintain a selected environment within a structure in which the assembly 10 is installed. By maintaining the doors 32, 34 in a closed position, an air or gas flow is not allowed to move or is substantially restricted through the shroud 20. Additionally, by providing the pockets 202, 204, respectively, in the doors 32, 34 and orifice wall 106, additional holding mechanisms are not required to hold the magnetic and striker portions. Accordingly, the pockets 202, 204 can be formed monolithically as one piece with the doors 32, 34 in the orifice wall 106.

Figure 16A:
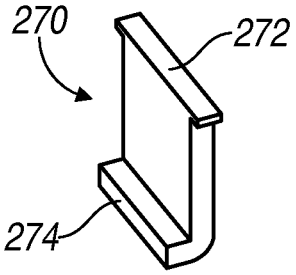
FIG. 16A is a magnetic assembly side plate.
Figure 16B:
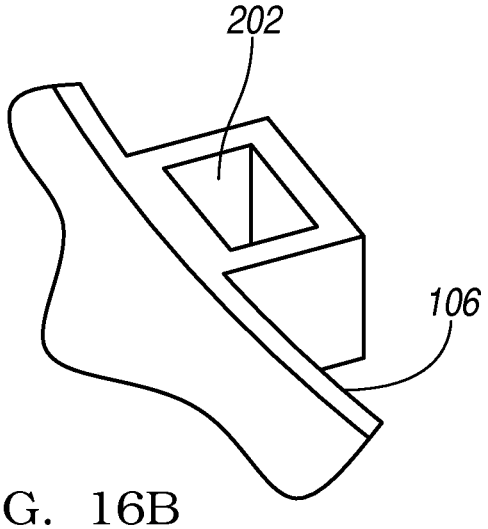
FIG. 16B is a magnetic assembly pocket.
Figure 16C:
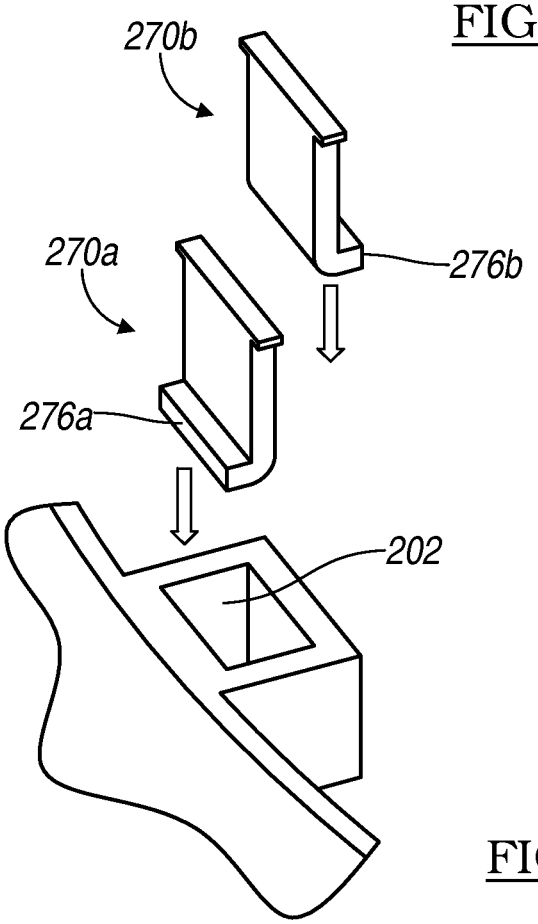
FIG. 16C is a detail environmental view of a magnetic assembly pocket and magnetic assembly side plates.
Figure 16D:
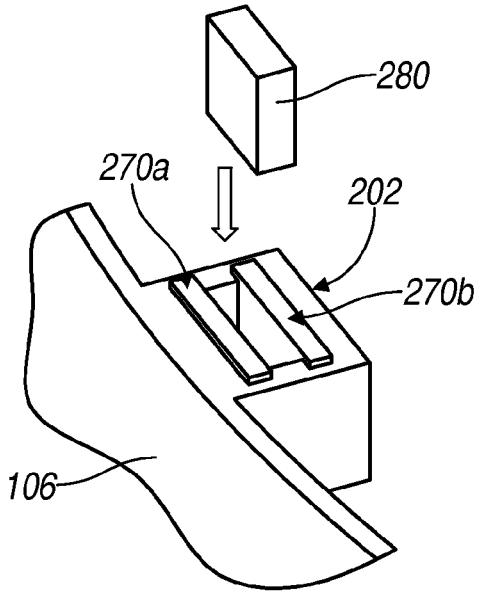
FIG. 16D is a partially assembled view of a magnetic assembly and magnetic assembly pocket.
Figure 16E:
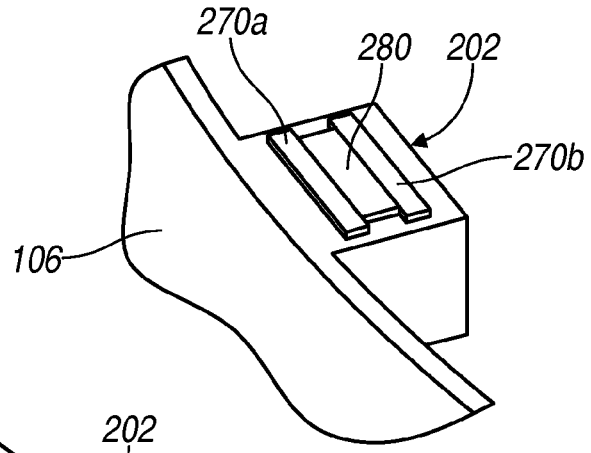
FIG. 16E is a fully assembled magnetic assembly in a magnetic assembly pocket.
Figure 16F:
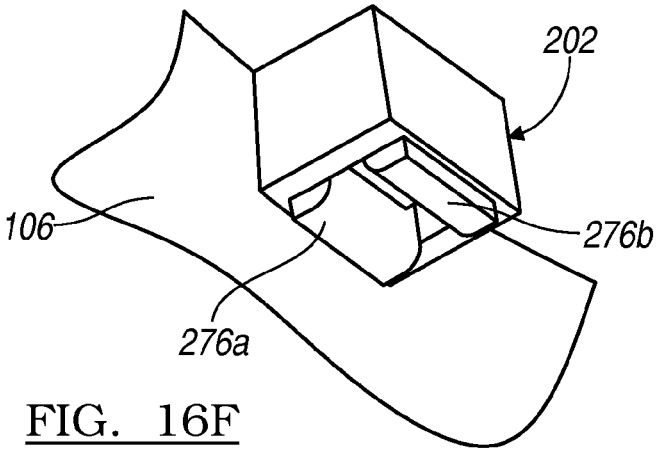
FIG. 16F is a perspective view of a magnetic assembly fully assembled in a magnetic assembly pocket.

With reference to FIGS. 16A-16E, the magnetic assembly pocket 202 can be formed or molded into the orifice wall 106 in an appropriate dimension. A magnetic assembly can be placed in the pocket 202. The magnetic assembly can include a magnetic side plate 270 that can include a first cross-end or t-shaped end 272 and a second j-shaped or finger extension end 274, as illustrated in FIG. 16A. To assemble the magnetic latch portion or magnetic assembly, two of the side plates 270*a* and 270*b* can be positioned into the magnetic assembly pocket 202 such that the j-finger portion 276*a, b* extends towards an exterior of the pocket 202. The t-shaped end 272 can engage a top of the pocket 202 or a first end of the pocket 202, as illustrated in FIG. 16D such that when a magnet 280 is positioned between the two plates 270*a*, 270*b* the j-shaped portions 276*a*, 276*b* are pushed against an underside of the pocket portion 202 to assist in holding the magnetic side plates 270*a*, 270*b* in position within the pocket 202. As illustrated in FIG. 16E, the magnet 280 is positioned between the two side plates 270*a*, 270*b* within the magnet pocket 202. The side plates 270*a*, 270*b* can assist in amplifying the latch force relative to the magnet 280 alone. Generally, the magnetic force can be transferred through the side places 270*a*, 270*b* to increase an area that is magnetized, relative to the doors 32, 34. Further, the side plates 270*a*, 270*b* can assist in centering the magnetic force relative to the pocket 202.

The side plates 270*a*, 270*b* along with the magnet 280 can be disengaged or uninstalled from the pocket 202 or installed into the pocket 202 without additional tools. In other words, as illustrated, the various portions of the magnetic assembly can be inserted, such as via sliding, into the pocket 202. The magnetic assembly can then be frictionally held within the pocket 202 and without the need for additional fasteners, such as a rivet or screw. The magnetic assembly may be free to float or move within the pocket 204, however. The magnetic assembly allows ease of removal and placement of the magnet 280 and the side plates 270*a*, 270*b*. The side plates 270*a*, 270*b* can also be formed of a substantially corrosion resistant material, such as selected stainless steels that can still act as magnetic force transfer elements.

Figure 17:
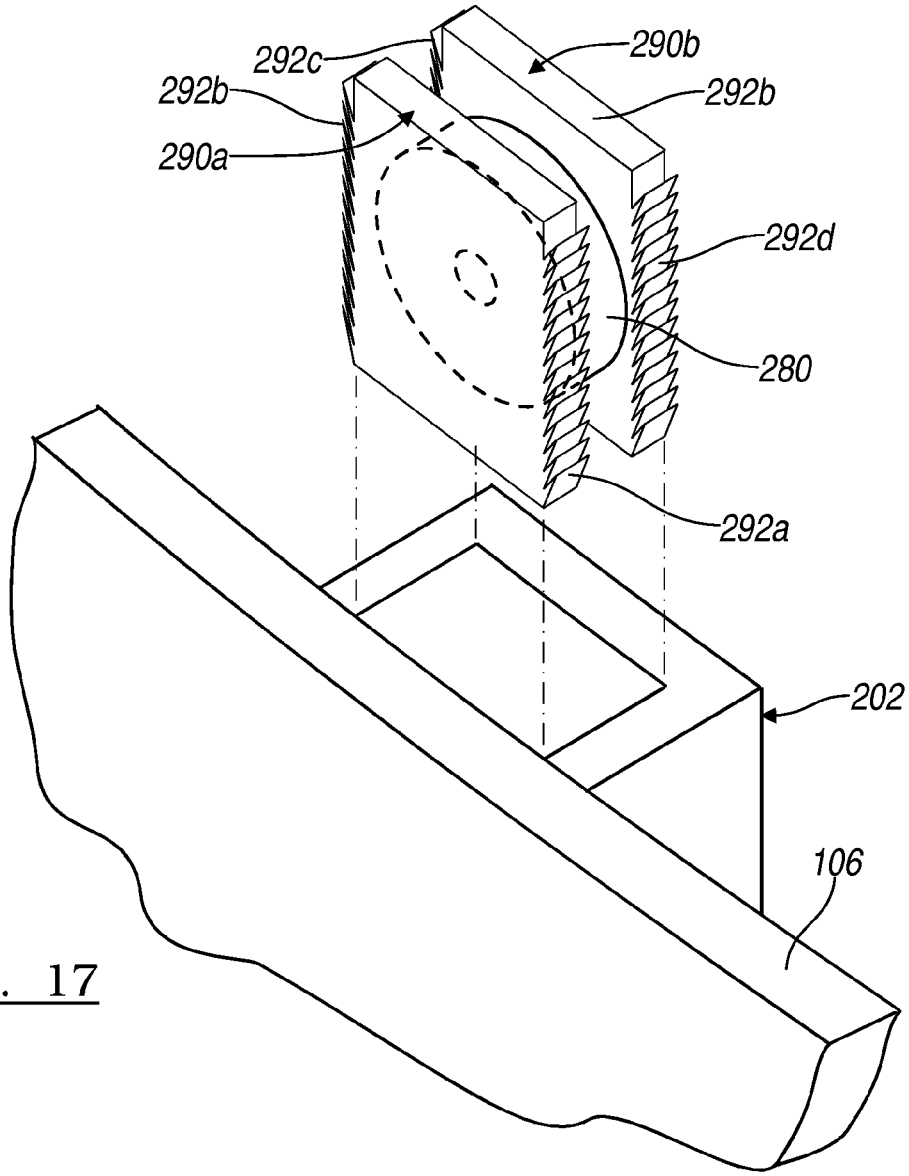
FIG. 17 is a detail view of an unassembled magnetic assembly from a magnetic assembly pocket.

According to various embodiments, as illustrated in FIG. 17, the pocket 202 formed with the orifice wall 106 can receive the magnet 280 positioned between two side plates 290*a*, 290*b*. The side plates 290*a*, 290*b* can be similar to the side plates 270*a*, 270*b* discussed above in that they can assist in maximizing or increasing a magnetic force area and alignment of the magnet 280 within the pocket 202 relative to the striker plate 300. The side plates 290*a*, 290*b*, however, can include serrated or shaped exterior edges 292*a-d*. The edges 292*a*-292*d* can include serrations, fingers, saw tooth designs, etc. to tightly engage an interior of the pocket 202. The serrations can engage the pocket 202 to hold the side plate 290*a*, 290*b* within the pocket 202 with the magnet 280 there between. The serrated or shaped edges 292*a*-292*d* can eliminate the need for other holding portions to hold the side plates 290*a*-290*b* within the pocket 202. The connection with the shaped portions can also be overcome to remove the assembly from the pocket 202. For example, a hammer or screw driver may be used to push the side plates 290*a*, 290*b* out of the pocket 202. Accordingly, it will be understood that the side plates and magnet 280 can be installed in the pocket 202 in selected various embodiments. The magnetic assembly with the side plates 290 can also be inserted without the need of additional tools.

Figure 18:
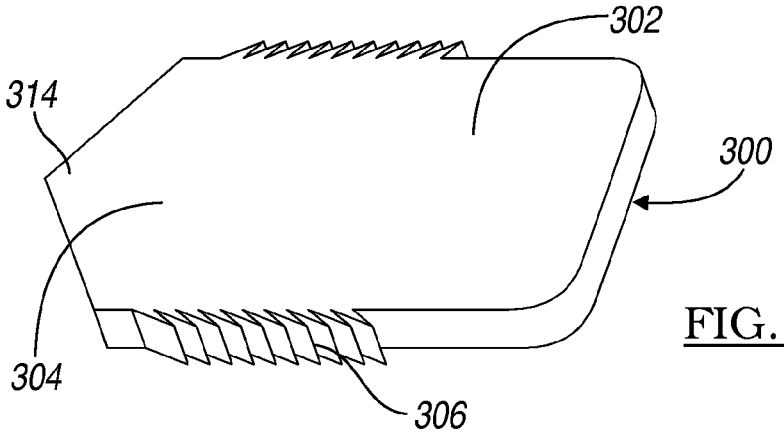
FIG. 18 is a plan view of a striker plate.

As discussed above, the doors 32, 34 can include striker pockets 204 position or hold a striker plate 300, as illustrated in FIG. 18. The striker 300 can be formed of a material that is magnetic, such as magnetic stainless steel. By providing the striker 300 in a non-corrosive material, such as stainless steel, the striker 300 can be formed to have a selected or increased longetivity.

Figure 20:
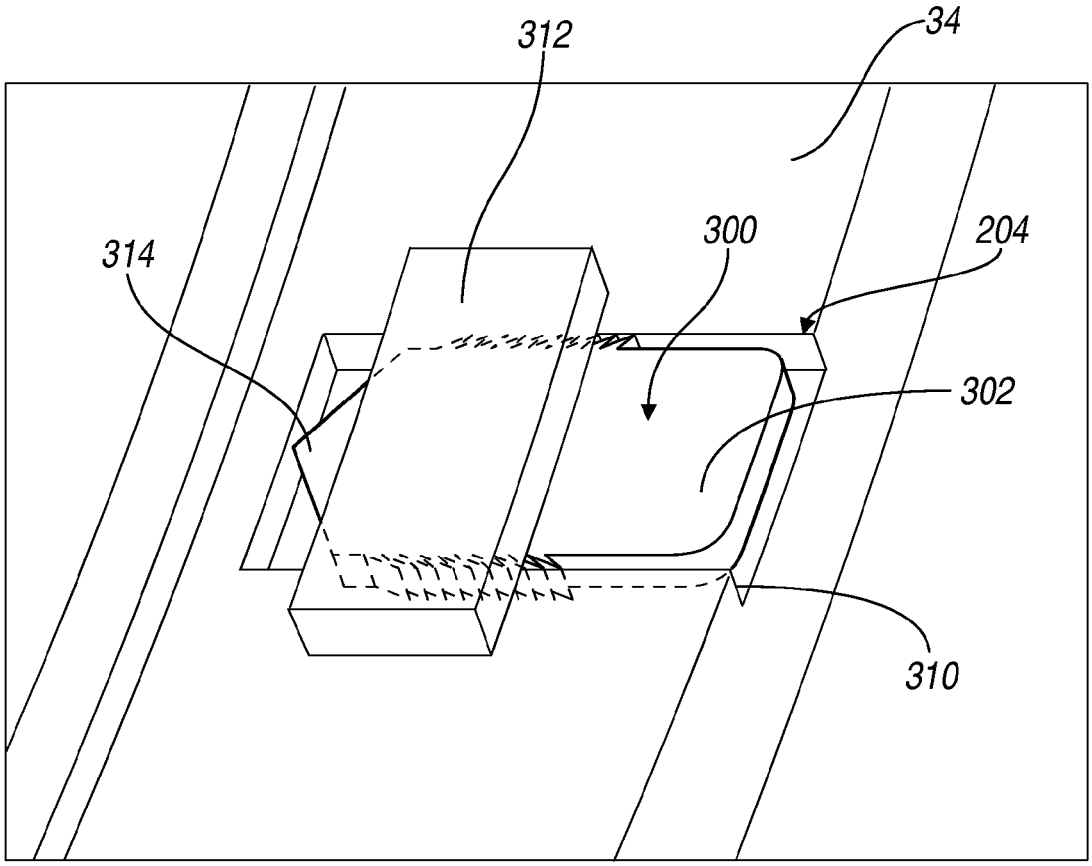
FIG. 20 is a detail view of a striker plate assembled in a striker plate pocket of a door member.

The striker 300 can include a striker end 302 and an insertion or door engaging end 304. The door engaging end can include a serration or shaped edge 306. Similar to the side plates 290*a*, 290*b*, the shaped or serrated edge 306 can engage a side wall 310 of the striker pocket 204, as illustrated in FIG. 20. The striker 300 can be provided in a selected number and in each of the striker pockets 204, as illustrated in FIG. 19. Nevertheless, each of the striker plates 300 can be pushed into the striker pocket 204 between the side walls 310 and under a pocket wall or bridge 312. The striker plate 300 can also include a pointed or driving end 314 that can assist in pushing the striker plate 300 under the pocket bridge 312 and disengaging or breaking any flashing or overmolding of plastic that covers a portion of the striker pocket 204. Accordingly, similar to the magnetic assembly, the striker plate 300 can be installed into the striker pocket 204 without a requirement for additional tools. Also, the striker plate 300 can be held in the striker pocket 204 without the need for additional fasteners, such as a screw or rivet.

The striker end 302 of the striker plate 300 can be exposed to engage the magnet 280 and the side plates 270 or 290, as discussed above. Once the installation is complete, as illustrated in FIGS. 1 and 9 when the doors 32, 34 are in the closed position, the striker plate 300 can engage a portion of the side plates 270 or 290 and the magnet 280 to assist in holding the door 32, 34 in the closed position. The magnetic force can be in addition to the biasing force provided by the springs 142, 144 and assist in holding the doors 32, 34 in the closed position. It will be understood that the number and strength of the magnetic assembly and strikers can be selected to achieve an appropriate closing or maintenance force of the doors in the closed position. Thus, providing the number of magnetic pockets and striker pockets as illustrated is not necessary and can be augmented depending upon the environment where the housing 10 is to be installed, the strength of the fan portion 11, and other appropriate factors. It will also be understood, that it can be possible to install the magnetic assembly into a pocket of the doors 32, 34, and the striker 300 into a pocket in the shroud wall 106 and the closing or biasing of the doors 32, 34 can be operated in a substantially similar manner.

It will be understood that the fan assembly 11 with the ventilation housing assembly 10 may be operated in any appropriate manner. The fan assembly 11 may be substantially manually operated such that an individual may be required to manually turn the fan assembly 11 on and off at a selected time. Alternatively, the fan assembly 11 may be operated by an on-site electronic sensor and/or processor system to monitor selected characteristics of a building, such as a farmhouse, and determine whether a selected characteristic is being met, such as an oxygen concentration, a carbon dioxide concentration, a temperature or other appropriate specifications. Further, the fan assembly 11 may be operated substantially remotely through various connections, such as internet connections, wireless connections, wired connections or the like, and can be monitored for various specifications in the farmhouse and operated accordingly. Further, the fan assembly 11 of the ventilation system 10 may be operated based on a time based system or other appropriately operating system.

Various appropriate monitoring and control systems may include the Chore-Tronic™ control system sold by CTB Inc. of Indiana or the control systems disclosed in U.S. Pat. No. 7,751,942 issued on Jul. 6, 2010, incorporated herein by reference. Regardless, the ventilation system 10 may be operated according to any appropriate manner to achieve selected results. The various structures and formations of the ventilation system 10 may also be formed as discussed above to achieve selected results.

The housing assembly 10, as illustrated in FIGS. 1 and 2 can be assembled from a plurality of components that are manufactured or formed, shipped to an assembly site, assembled into the housing, and installed into a structure. Generally, as discussed above, the shroud 20 can be formed as a single piece or monolithic structure with the doors 32, 34. As illustrated in FIGS. 12 and 13A, the shroud 20 and doors 32, 34 can be molded as a single piece. Additionally, the shroud 20 can be molded to include the magnetic assembly pockets 202 and the doors 32, 34 can be molded to include the striker pockets 204. The shroud 20 can also include the stacking spacers 150 to allow a plurality of the shrouds 20 to be stacked, as illustrated in FIG. 11.

It can be selected, prior to shipping, that the doors 32, 34 can be separated, such as via cutting, from the remainder of the shroud 20. The magnetic assemblies, including the side plates 270 or 290 and the magnet 280, and the striker plates 300 can be inserted into the magnetic assembly pockets 202 and striker pockets 204, respectively. The doors 32, 34 can then be stacked in between the shrouds 20, as illustrated in FIG. 11 with the fully assembled magnetic assemblies and strikers. At a selected time, such as at the installation site and during assembly of the fan assembly housing 10, the hinge pins 214 can be inserted into the doors 32, 34 and the doors 32, 34 can be connected with the shroud 20. As discussed above, each of the doors 32, 34 can include two pins that are fit into the hinge pin pockets or slots formed in the doors 32, 34. The doors 32, 34 can also be biased, such as with a biasing springs 142, 144 as illustrated in FIG. 9.

Figure 8A:
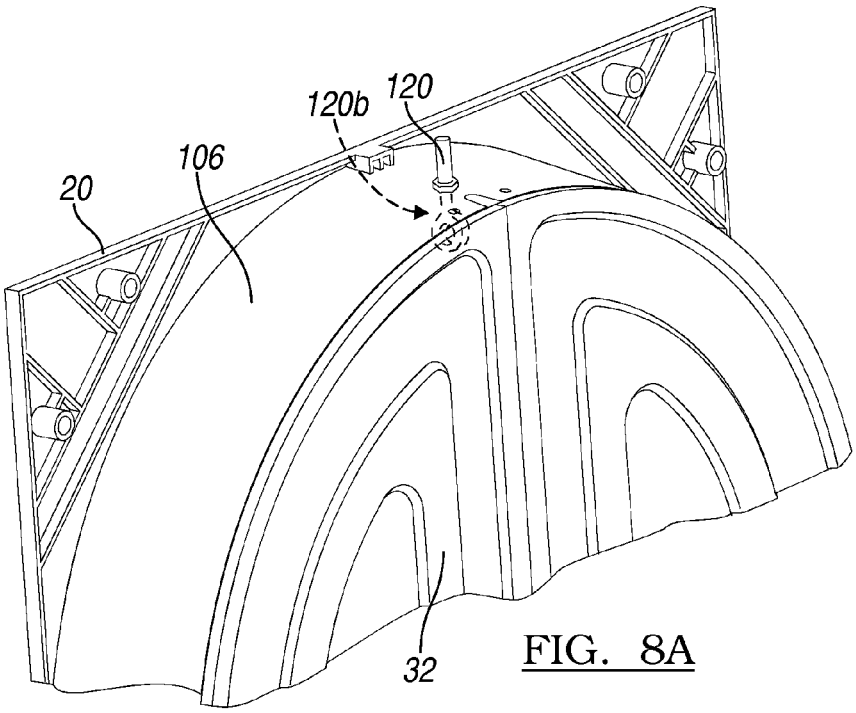
FIG. 8A is a detail view of a shroud and a locator member.
Figure 8B:
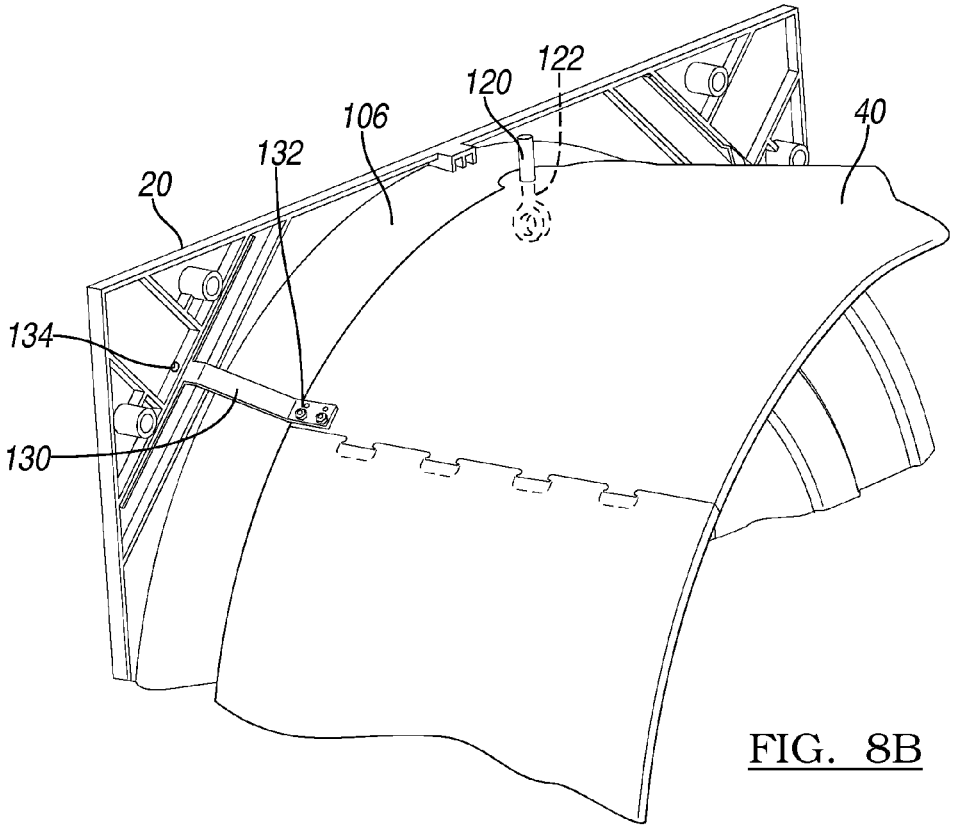
FIG. 8B is a detail view of a shroud and diffuser connected.

The diffuser 40 can be formed of a plurality of the panels 60, as illustrated in FIGS. 3-5. A piece of material can be extruded or formed from which the panels 60 are cut. Again, each of the panels can include the tabs 72 and the slots 70 for interconnecting a plurality of the panels 60 to form the diffuser 40. After the diffuser 40 is formed it can be interconnected with the shroud 20, as illustrated in FIGS. 8A and 8B. Nevertheless, the diffuser panels 60 can be formed to be substantially flat, as discussed above, to allow for substantially efficient and tight packing of a plurality of the diffuser panels 60.

Accordingly, at an installation site, a package of the diffuser panels can be provided in combination with or in addition to a package of the shrouds and doors that have been neatly and efficiently stacked and shipped to a site. An installation individual or team can then unpack the stacked shrouds 20, doors 32, 34, and diffuser panel pieces 600 and interconnect the various portions as illustrated and discussed above. The housing assembly 10 can then be completed and the fan portion 11 can be installed and operated to move gases through the housing assembly 10, as discussed above.

Additionally, each portion of the housing assembly 10, or at least including the diffuser 40, can be formed or coated with a substantially opaque material. A coated or opaque material can be similar to that disclosed in U.S. Pat. No. 7,966,974 issued on Jun. 28, 2011, and incorporated herein by reference. The opaque material or coating can ensure substantially no light transmission into a structure in which the housing assembly 10 is installed to maintain a selected light control within the structure.

The teachings herein are merely exemplary in nature and, thus, variations that do not depart from the gist of the teachings are intended to be within its scope. Such variations are not to be regarded as a departure from the spirit and scope of the teachings.

What is claimed is:

1. A method of manufacturing a housing assembly for a fan portion, comprising:

forming a three dimensional shroud assembly as a single piece, comprising:

a shroud having a face-wall that substantially defines a face-wall plane and an orifice wall extending from the face-wall in a first direction;

a door configured to at least partially close a passage through the shroud defined at least by the orifice wall and formed to be separated from the shroud;

a magnet pocket formed with one of the orifice wall or the door, wherein the magnetic pocket includes at least one open end to receive a magnetic assembly;

a striker pocket on one of the door or the orifice wall, wherein the striker pocket is configured to contain a striker member;

a plurality of spacers surrounding an exterior of the orifice wall and having a sidewall extending from the face-wall in the first direction, wherein the plurality of spacers are configured to space the formed three dimensional shroud assembly;

forming the magnetic assembly to be fixed within the magnet pocket without additional fasteners;

forming the striker member to be fixed within the striker pocket without additional fasteners;

fixing the magnetic assembly in the magnetic pocket at least by passing a first j-shaped portion of a first side plate into the magnet pocket, engaging a top of the magnet pocket with a first t-shaped portion of the first side plate, passing a second j-shaped portion of a second side plate into the magnet pocket, engaging the top of the magnet pocket with a second t-shaped portion of the second side plate, positioning a magnet between the first side plate and the second side plate within the magnet pocket;

providing a plurality of hinge pins to operably interconnect the door and the shroud to allow movement of the door relative to the face-wall; and providing a plurality of substantially flat diffuser members, wherein each flat diffuser member includes a tab at a first edge and a slot formed near a second edge, wherein the provided plurality of substantially flat diffuser members are configured to be connected with the respective tab and slot to form a diffuser configured to be connected to the formed shroud;

wherein the orifice wall and the magnet pocket on the orifice wall are formed together as one piece.

2. The method of claim 1, wherein the magnet pocket is formed on an interior of the orifice wall and the striker pocket is formed on the exterior of the door, and upon separating the door from the shroud, the doors are reversed to position an exterior of the door to the interior to locate the striker pocket adjacent the magnet pocket on the interior of the orifice wall.

3. The method of claim 2, further comprising:

inserting a magnetic assembly into the magnetic assembly pocket;

inserting a striker plate into the striker pocket; and retaining both the inserted magnetic assembly and the inserted striker plate with friction within the respective magnetic assembly pocket and the striker pocket.

4. The method of claim 3, wherein at least the magnetic assembly is moveable within the magnetic assembly pocket.

5. The method of claim 1, wherein the door is formed to include a first hinge pocket and a second hinge pocket;

inserting a first hinge pin of the provided plurality of hinge pins in the first hinge pocket and inserting a second hinge pin of the provided plurality of hinge pins in the second pocket.

6. The method of claim 1, further comprising:

forming a double D rib pattern in the door, wherein the door is formed of a material having a material thickness and the double D rib pattern in the door forms a door thickness greater than the material thickness.

7. The method of claim 1, wherein providing the plurality of substantially flat diffuser members, includes forming each diffuser member from plastic as a substantially flat member to include the tab formed with an undercut to include a first length greater than a length of the slot and a second length similar or slightly longer than the length of the slot.

8. The method of claim 1, further comprising:

stacking a plurality of the shrouds with at least two of the doors between each of the plurality of shrouds in the stack.

9. The method of claim 1, further comprising:

forming the provided plurality of substantially flat diffuser members;

forming a diffuser by interconnecting in series at least a sub-plurality of the formed plurality of substantially flat diffuser members by passing at least one formed tab through at least one formed slot in the series of the sub-plurality of the formed plurality of substantially flat diffuser members.

10. A method of manufacturing a housing assembly for a fan portion, comprising:

forming a three dimensional shroud assembly as a single piece, comprising:

a shroud having a face-wall that substantially defines a face-wall plane and an orifice wall extending from the face-wall in a first direction;

a door configured to at least partially close a passage through the shroud defined at least by the orifice wall and formed to be separated from the shroud;

a magnet pocket formed with one of the orifice wall or the door, wherein the magnetic pocket includes at least one open end to receive a magnetic assembly;

a striker pocket on one of the door or the orifice wall, wherein the striker pocket is configured to contain a striker member;

a plurality of spacers surrounding an exterior of the orifice wall and having a sidewall extending from the face-wall in the first direction, wherein the plurality of spacers are configured to space the formed three dimensional shroud assembly;

forming the magnetic assembly to be fixed within the magnet pocket without additional fasteners;

forming the striker member to be fixed within the striker pocket without additional fasteners;

providing a plurality of hinge pins to operably interconnect the door and the shroud to allow movement of the door relative to the face-wall;

providing a plurality of substantially flat diffuser members, wherein each flat diffuser member includes a tab at a first edge and a slot formed near a second edge, wherein the provided plurality of substantially flat diffuser members are configured to be connected with the respective tab and slot to form a diffuser configured to be connected to the formed shroud;

fixing the magnetic assembly in the pocket at least by pushing a first side plate into the magnet pocket to engage a first internal surface of the magnet pocket with a first serration formed at an outer edge of the first side plate, pushing a second side plate into the magnet pocket to engage a second internal surface of the magnet pocket with a second serration formed at an outer edge of the second side plate, and positioning a magnet between the first side plate and the second side plate within the magnet pocket;

wherein the orifice wall and the magnet pocket on the orifice wall are formed together as one piece.

11. A housing assembly for a fan portion, comprising:

a shroud having a face-wall portion configured to be mounted to a structure and an orifice wall extending from the face-wall portion, wherein a passage is formed by the orifice wall and a magnet pocket is formed with the shroud, wherein the magnet pocket includes an interior formed by at least a wall of the magnet pocket;

a door member configured to selectively block at least a portion of the passage in a closed position, wherein the door member includes a striker pocket formed during formation of the door member at least as a depression including a first wall and a second opposed wall extending into the door member from a first surface of the door member;

a striker member having a driving end configured to be pushed into the striker pocket and at least a first edge including a serration to fix the striker member within the striker pocket formed in the door member without additional fasteners; and a magnetic closure assembly fixable in the interior of the magnet pocket formed in the shroud, wherein the magnetic closure assembly includes, a first side plate, a second side plate, and a magnet positioned between the first side plate and the second side plate, wherein the first side plate, the second side plate, and the magnet are installed in the magnet pocket without additional tools;

wherein the door member is configured to be held in the closed position by the striker member being magnetically held by the magnetic closure assembly.

12. The housing assembly of claim 11, wherein the first side plate includes a first cross end having a j-shape and a second cross end having a t-shape;

wherein the second side plate includes a third cross end having a j-shape and a first cross end having a t-shape.

13. The housing assembly of claim 11, wherein the first side plate includes at least a first one of a serration, a finger, or a saw tooth to engage the interior of the magnet pocket;

wherein the second side plate includes at least a second one of a serration, a finger, or a saw tooth to engage the interior of the magnet pocket.

14. The housing assembly of claim 11, wherein the door member includes a first door and a second door both moveable towards one another to open the passage.

15. The housing assembly of claim 14, wherein each of the first door and the second door is formed from a material having a substantially uniform material thickness, wherein each of the first door and the second door is shaped to have a ribbed configuration to define a door thickness, wherein the door thickness is a distance between a first peak of the ribbed configuration and a second peak of the ribbed configuration opposite the first peak so that the door thickness is greater than the material thickness;

wherein the ribbed configuration includes a first raised rib portion and second raised rib portion and at least one valley between the first raised rib portion and the second raised rib portion, wherein the first raised rib portion, the second raised rib portion, and the at least one valley generally define a double D ribbed configuration having a first closed D smaller and within a second open D.

16. The housing assembly of claim 14, further comprising:

at least four hinge pins;

wherein each of the first door and the second door is molded to define at least two hinge pockets, one hinge pocket of the two hinge pockets being formed into each end of the respective first door and the second door; and wherein one hinge pin of the at least four hinge pins is positioned in each one hinge pocket.

17. The housing assembly of claim 11, further comprising:

a diffuser defined by a plurality of diffuser members configured to be interconnected, wherein each of the plurality of diffuser members includes a plurality of slots on a first side and a plurality of tabs on a second side opposite the first side, wherein the diffuser is coupled to the shroud;

wherein the each of the plurality of diffuser members is substantially flat across a first major surface and a second major surface, where both the first major surface and the second major surface extend between the first side that includes the plurality of slots and the second side that includes the plurality of tabs at least prior to being interconnected with another of the diffuser members.

18. The housing assembly of claim 17, further comprising:

a grill member having an external geometry defined by an outer most annular member, wherein the outer most annular member is operable to contact an annular interior of the diffuser that is formed by interconnection of the plurality of diffuser members.

19. A housing assembly for a fan portion, comprising:

a shroud having a face-wall portion to be mounted to a structure and an orifice wall extending from the face-wall portion, wherein an inner surface of the orifice wall forms a passage;

a diffuser coupled to the shroud, wherein the diffuser is formed of a plurality of substantially flat sheet plastic diffuser members coupled together in series by a tab formed at a first edge of each substantially flat sheet plastic diffuser member received in a slot formed near an edge of a second edge of each substantially flat sheet plastic diffuser members; and a tubular support member coupled to and surrounding the orifice wall to maintain a circumference of the orifice wall;

a door member molded to define at least two hinge pockets, one of the two hinge pockets being formed into each end of the door member;

at least two hinge pins, wherein one hinge pin of the two hinge pins is positioned in each hinge pocket of the two hinge pockets formed into the door member;

a first striker member positioned in a first striker pocket molded into the door member as a recess into the door between two surfaces of the first striker pocket and a striker pocket bridge over the recess, wherein the first striker member is pushed into the first striker pocket; and a first magnetic assembly having at least a side plate having at least one serration and a magnet member positioned in an interior of a first magnetic assembly pocket molded into the orifice wall;

wherein each hinge pin is positioned in a respective bore formed in the orifice wall to allow movement of the door member relative to the face-wall between an open position and a closed position;

wherein the tubular support member provides a clearance for movement of the door member into a volume at least partially encompassed by the diffuser when coupled to the shroud;

wherein in the closed position the first striker member magnetically interacts with the first magnetic assembly to assist in maintaining the door member in the closed position;

wherein the diffuser is mounted over the tubular support member to position the diffuser relative to the orifice wall.

20. The housing assembly of claim 19, further comprising:

a grill coupled near an outlet of the diffuser having an outer most substantially rigid substantially circular member positioned to contact an interior circumferential surface of the diffuser to maintain the diffuser in a selected substantially circular shape by the outer most substantially rigid substantially circular member of the grill.

21. The housing assembly of claim 19, wherein the door member is formed from a material having a substantially uniform material thickness and shaped into a ribbed configuration to define a door thickness that has a distance between two opposing peaks of the ribbed configuration, wherein the door thickness is greater than the material thickness;

wherein the ribbed configuration includes a first raised rib portion and second raised rib portion and at least one valley between the first raised rib portion and the second raised rib portion;

wherein the first raised rib portion, the second raised rib portion, and the at least one valley generally define a double D ribbed configuration have a first closed D within a second open D;

wherein the second open D has an edge at an edge of the door member.

22. A housing assembly for a fan portion, comprising:

a shroud having a face-wall portion operable to be mounted to a support member of a structure, the face-wall portion generally defining a geometric shape having at least a side configured to be positioned near the support member, a corner adjacent to the side, and a passage formed through the shroud;

an orifice wall extending at a non-zero angle from the face-wall portion around the passage and further defining the passage;

a support member contacting and exterior surface and support the orifice wall;

a diffuser contacting the support member and spaced from the orifice wall by the support member;

a fixation member extending through the orifice wall between a first end and a second end;

a first door having a hinge pocket;

a hinge pin received in the hinge pocket and a bore formed through the orifice wall, wherein the first door is configured to move between and open position and a closed position;

a second door, wherein the first door and the second door are operable to move between an open position and a closed position relative to the passage by rotating relative to the orifice wall via the respective a first pair of hinge pins and a second pair of hinge pins;

a first striker member positioned in a first striker pocket molded into the first door and a second striker member positioned in a second striker pocket molded into the second door; and a first magnetic assembly having a side plate with a serration pushed into a first magnetic assembly pocket molded into the orifice wall and a second magnetic assembly positioned in a second magnetic assembly pocket molded into the orifice wall and spaced apart from the first magnetic assembly pocket;

wherein in the closed position the first striker member magnetically interacts with the first magnetic assembly to assist in maintaining the first door in the closed position and the second striker member magnetically interacts with the second magnetic assembly to assist in maintaining the second door in the closed position;

wherein a transition radius is formed from the face-wall portion to the orifice wall where the orifice wall extends from the face-wall portion, wherein the transition radius includes a first transition radius at the side and a second transition radius at the corner;

wherein the first end of the fixation member is selectively coupled to the diffuser and wherein the second end of the fixation member is coupled to the first door a biasing member to bias the first door towards the shroud;

wherein the first transition radius is smaller than the second transition radius.

23. The housing assembly of claim 22, wherein the first transition radius is about 0.25 millimeters (mm) (about 0.01 inches) to about 7.6 mm (about 0.3 inches) and the second transition radius is about 76 mm (about 3 inches) to about 101 mm (about 4 inches).

24. The housing assembly of claim 22, wherein the first transition radius is about 10 times larger than the second transition radius.

25. The housing assembly of claim 22, further comprising:

a diffuser assembly including a plurality of diffuser members connected together with a tab and slot connection, wherein a first tab extending in planar alignment with a mating surface of a first diffuser member of the plurality of diffuser members is positioned through a cooperating slot in a second diffuser member of the plurality of diffuser members;

wherein each of the plurality of diffuser members is connected at a first end and a second end to another of the plurality of diffuser members;

wherein each of the plurality of diffuser members includes a substantially flat first major surface and opposed second major surface extending between the first side and the second side;

wherein each of the diffuser panels is formed of a plastic.

* * * * *